US011738436B2

(12) United States Patent
Furusawa et al.

(10) Patent No.: US 11,738,436 B2
(45) Date of Patent: Aug. 29, 2023

(54) ROTARY HAMMER

(71) Applicant: MAKITA CORPORATION, Anjo (JP)

(72) Inventors: Masanori Furusawa, Anjo (JP); Hajime Takeuchi, Anjo (JP)

(73) Assignee: MAKITA CORPORATION, Anjo (JP)

( * ) Notice: Subject to any disclaimer, the term of this patent is extended or adjusted under 35 U.S.C. 154(b) by 198 days.

(21) Appl. No.: 17/155,216

(22) Filed: Jan. 22, 2021

(65) Prior Publication Data

US 2021/0237248 A1 Aug. 5, 2021

(30) Foreign Application Priority Data

Feb. 3, 2020 (JP) ..... 2020-016065

(51) Int. Cl.
*B25D 16/00* (2006.01)
*B25D 17/04* (2006.01)

(52) U.S. Cl.
CPC ..... *B25D 16/006* (2013.01); *B25D 16/003* (2013.01); *B25D 17/043* (2013.01); *B25D 2216/0084* (2013.01); *B25D 2217/0073* (2013.01); *B25D 2250/095* (2013.01); *B25D 2250/265* (2013.01)

(58) Field of Classification Search
CPC ..... B25D 16/006; B25D 2216/0015; B25D 2216/0023; B25D 2216/0084; B25D 2250/261
See application file for complete search history.

(56) References Cited

U.S. PATENT DOCUMENTS 3,847,233 A * 11/1974 Glover ..... H01H 3/20 200/318.2
6,550,545 B1 * 4/2003 Manschitz ..... B25D 16/006 173/217
7,828,073 B2 * 11/2010 Liebert ..... H01H 9/06 173/171

(Continued)

FOREIGN PATENT DOCUMENTS

GB 2314288 A * 12/1997 ..... B25D 16/006
JP 2004330379 A * 11/2004 ..... B25D 16/006

(Continued)

*Primary Examiner* — Thomas M Wittenschlaeger
*Assistant Examiner* — David G Shutty
(74) *Attorney, Agent, or Firm* — Oliff PLC

(57) ABSTRACT

A rotary hammer includes a motor, a manipulation member, a main switch, a mode-switching member, a first locking member and a second locking member. The first locking member is configured to selectively lock the manipulation member in an OFF position according to a switching position of the mode-switching member. The second locking member is configured to selectively lock the manipulation member in an ON position according to the switching position of the mode-switching member. The first locking member is allowed to lock the manipulation member in the OFF position both when a hammer mode has been selected and when a drill mode has been selected. The motor is allowed to be driven in a state in which the manipulation member is locked in the ON position by the second locking member only when the hammer mode has been selected.

18 Claims, 17 Drawing Sheets

(56) References Cited

U.S. PATENT DOCUMENTS

| | | | | |
|---|---|---|---|---|
| 8,286,724 | B2 * | 10/2012 | Furusawa | H01H 3/20 173/48 |
| 2003/0037937 | A1 * | 2/2003 | Frauhammer | B25F 5/006 173/48 |
| 2003/0226673 | A1 * | 12/2003 | Burger | B25D 16/006 173/48 |
| 2004/0020670 | A1 * | 2/2004 | Kusmierski | H01H 21/10 173/217 |
| 2006/0011361 | A1 * | 1/2006 | Shimma | H01H 9/06 173/48 |
| 2006/0060365 | A1 * | 3/2006 | Kunz | H01H 3/20 173/217 |
| 2006/0185866 | A1 * | 8/2006 | Jung | B25D 16/006 173/48 |
| 2008/0017396 | A1 * | 1/2008 | Kristen | B25D 16/006 173/162.2 |
| 2009/0056965 | A1 * | 3/2009 | Moessnang | B25D 16/006 173/18 |
| 2011/0308920 | A1 * | 12/2011 | Shi | B25F 5/02 200/43.17 |
| 2016/0023344 | A1 * | 1/2016 | Bernhart | B25F 5/02 74/813 L |
| 2018/0085906 | A1 * | 3/2018 | Nitsch | B25D 16/006 |
| 2018/0099395 | A1 * | 4/2018 | Iida | H01H 9/06 |
| 2018/0250802 | A1 * | 9/2018 | Iida | B25D 16/006 |

FOREIGN PATENT DOCUMENTS

| | | | | | |
|---|---|---|---|---|---|
| JP | 2008272880 | A | * | 11/2008 | B25D 16/00 |
| JP | 2016068190 | A | * | 5/2016 | B25D 16/00 |
| JP | 2018-058183 | A | | 4/2018 | |

* cited by examiner

ROTARY HAMMER

CROSS-REFERENCE TO RELATED APPLICATIONS

The present application claims priority to Japanese patent application No. 2020-016065 filed on Feb. 3, 2020, contents of which are entirely incorporated herein by reference.

TECHNICAL FIELD

The present disclosure relates to a rotary hammer that is configured to operate in a mode that is selected from a plurality of modes.

BACKGROUND

Known rotary hammers are configured to operate in a mode that is selected by a user from a plurality of modes. The modes of the rotary hammer typically include a mode in which a tool accessory is only linearly driven (this mode is also called a hammer mode), and a mode in which the tool accessory is at least rotationally driven (this mode is also called a drill mode).

SUMMARY

According to one aspect of the present disclosure, a rotary hammer is provided that is configured to operate in a mode selected from a plurality of modes including a hammer mode, in which a tool accessory is only linearly driven along a driving axis, and a drill mode, in which the tool accessory is at least rotationally driven around the driving axis. The rotary hammer includes a motor, a manipulation member, a main switch, a mode-switching member, a first locking member and a second locking member.

The motor is configured to drive the tool accessory. The manipulation member is configured to be held in an OFF position in a non-pressed state and to move to an ON position in response to an external manual pressing being performed on the manipulation member by a user. The main switch is configured to be kept OFF when the manipulation member is in the OFF position and to be kept ON when the manipulation member is in the ON position. The mode-switching member is configured to be switched between a plurality of switching positions in response to an external manipulation being performed on the mode-switching member by the user for selecting one of the plurality of modes. The plurality of switching positions respectively correspond to the plurality of modes. The first locking member is configured to selectively lock the manipulation member in the OFF position according to the switching position of the mode-switching member. The second locking member is configured to selectively lock the manipulation member in the ON position according to the switching position of the mode-switching member. Further, the rotary hammer is configured such that the first locking member is allowed to lock the manipulation member in the OFF position both when the hammer mode has been selected and when the drill mode has been selected. The rotary hammer is further configured such that the motor is allowed to be driven in a state in which the manipulation member is locked in the ON position by the second locking member only when the hammer mode has been selected.

DETAILED DESCRIPTION OF THE EMBODIMENTS

Embodiments of the present disclosure will be hereinafter described with reference to the drawings.

First Embodiment

A rotary hammer 101 according to a first embodiment will be described below, with reference to FIG. 1 through FIG. 11. The rotary hammer 101 is a power tool that is capable of performing an operation (hereinafter referred to as a hammering operation) of linearly driving a tool accessory 18 that is mounted (attached, coupled) to a tool holder 34 along a driving axis A1, and an operation (hereinafter referred to as a drilling operation) of rotationally driving the tool accessory 18 around the driving axis A1.

Figure 1:
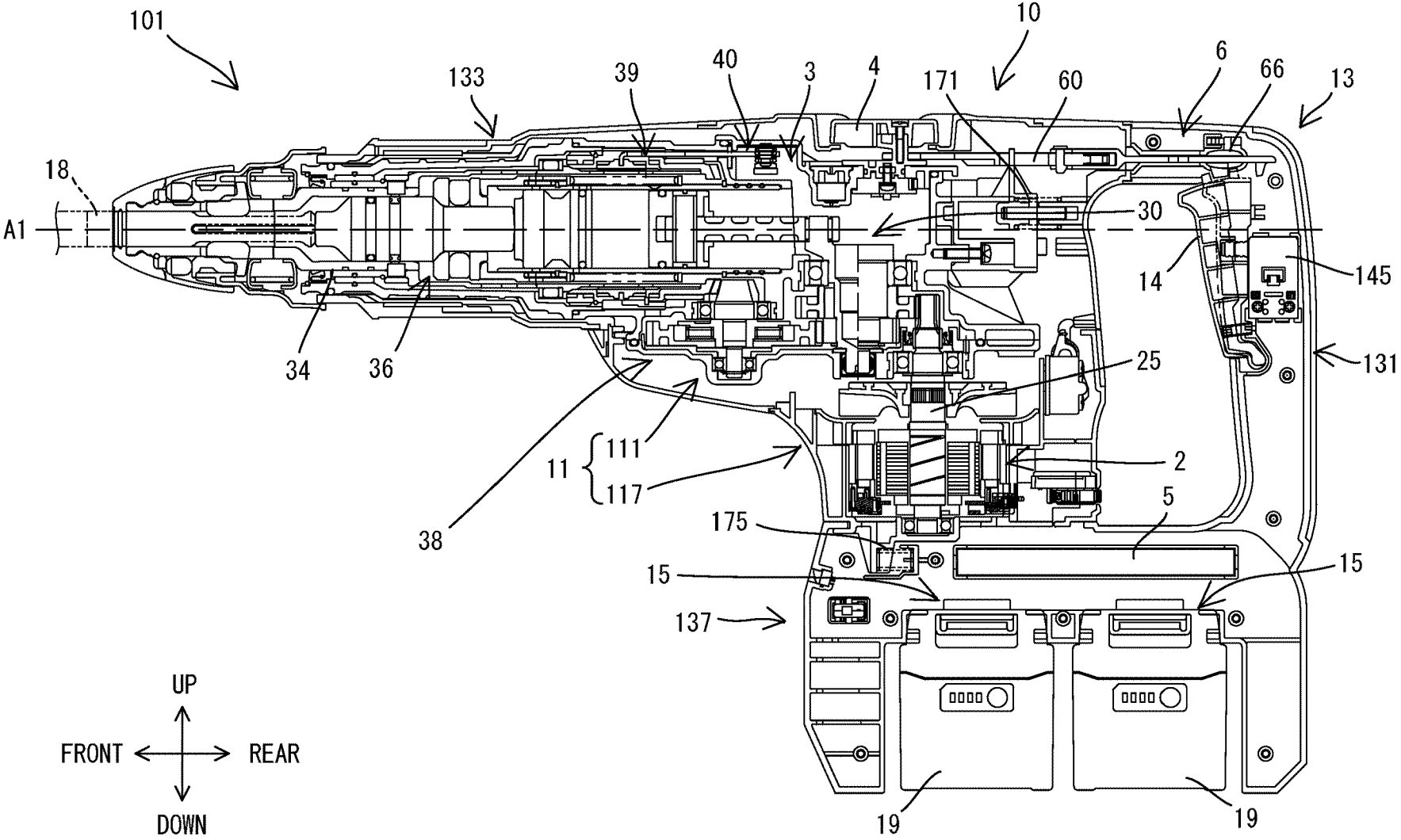
FIG. 1 is a cross-sectional view of a rotary hammer wherein a hammer mode has been selected.

Firstly, the general structure of the rotary hammer 101 is described with reference to FIG. 1. As shown in FIG. 1, an outer shell of the rotary hammer 101 is mainly formed by a housing 10. The housing 10 of the present embodiment is formed as a so-called vibration-isolating housing. The housing 10 includes a first housing 11 and a second housing 13 that is elastically connected to the first housing 11 so as to be movable relative to the first housing 11.

The first housing 11 has a generally L-shape as a whole. The first housing 11 includes a motor-housing part 117 that houses a motor 2, and a driving-mechanism-housing part 111 that houses a driving mechanism 3, which is configured to drive the tool accessory 18 using power generated by the motor 2.

The driving-mechanism-housing part 111 has an elongate shape and extends along the driving axis A1. The tool holder 34, to which the tool accessory 18 is detachably attachable, is disposed in one end portion of the driving-mechanism-housing part 111 in its longitudinal direction. The motor-housing part 117 is fixed to the other end portion of the driving-mechanism-housing part 111 in the longitudinal direction. The motor-housing part 117 protrudes from the driving-mechanism-housing part 111 in a direction that intersects the driving axis and away from the driving axis A1. The motor 2 is disposed such that a rotational axis of a motor shaft 25 is orthogonal to the driving axis A1.

For the sake of convenience in the following description, the directions of the rotary hammer 1 are related in the following manner. An extension direction of the driving axis A1 of the rotary hammer 101 (the extension direction of the longitudinal axis of the driving-mechanism-housing part 111) is defined as a front-rear direction of the rotary hammer 101. In the front-rear direction, a side on which the tool holder 34 is located is defined as a front side of the rotary hammer 101 (also referred to as a front-region side), and the opposite side thereof is defined as a rear side. An extension direction of the rotational axis of the motor shaft 25 is defined as an up-down direction of the rotary hammer 101. In the up-down direction, a direction toward which the motor-housing part 117 protrudes from the driving-mechanism-housing part 111 is defined as a downward direction, and the opposite direction thereof is defined as an upward direction. A direction that is orthogonal to both of the front-rear direction and the up-down direction is defined as a left-right direction.

The second housing 13 is a hollow body that is generally U-shaped as a whole. The second housing 13 includes a grip 131, an upper part 133 and a lower part 137.

The grip 131 is configured to be gripped (held) by a user. The grip 131 is spaced rearward from the first housing 11 and extends in the up-down direction. A trigger 14 is disposed at a front side of the grip 131. The trigger 14 is configured to be depressed (pulled) by a user using a finger. The upper part 133 is connected to an upper end portion of the grip 131. In the present embodiment, the upper part 133 extends frontward from the upper end portion of the grip 131 and covers the most part of the driving-mechanism-housing part 111 of the first housing 11. The lower part 137 is connected to a lower end portion of the grip 131. In the present embodiment, the lower part 137 extends frontward from the lower end portion of the grip 131, and the most part of the lower part 137 is disposed below the motor-housing part 117. Battery-mounting parts 15 are disposed on a center portion in the front-rear direction of a lower end of the lower part 137. Batteries 19, that are detachably attached to the battery-mounting parts 15, each serve as a power source for supplying electric power to the rotary hammer 101.

With the above-described structure, in addition to the second housing 13, the motor-housing part 117 of the first housing 11 is interposed between the upper part 133 and the lower part 137 in the up-down direction and is exposed outside of the rotary hammer 1. The second housing 13 and the motor-housing part 117 form (define) an outer surface of the rotary hammer 101.

The detailed structure of the rotary hammer 101 is now described.

Firstly, a vibration-isolating structure of the housing 10 is described with reference to FIG. 1. As described above, the second housing 13 including the grip 131 is elastically connected to the first housing 11, which houses the motor 2 and the driving mechanism 3, to be movable relative to the first housing 11.

More specifically, as shown in FIG. 1, an elastic member 171 is interposed between the driving-mechanism-housing part 111 of the first housing 11 and the upper part 133 of the second housing 13. An elastic member 175 is interposed between the motor-housing part 117 of the first housing 11 and the lower part 137 of the second housing 13. In the present embodiment, a compression coil spring is adopted as each of the elastic members 171 and 175. Each of the elastic members 171 and 175 biases the first housing 11 and the second housing 13 away from each other (such that the grip 131 is spaced away from the first housing 11) in the extension direction of the driving axis A1. In other words, the first housing 11 and the second housing 13 are biased to forward and the rearward, respectively.

The upper part 133 and the lower part 137 are slidable relative to an upper end portion and a lower end portion of the motor-housing part 117, respectively. More specifically, a lower end surface of the upper part 133 and an upper end surface of the motor-housing part 117 are slidable relative to each other. Further, an upper end surface of the lower part 137 and a lower end surface of the motor-housing part 117 are slidable relative to each other. Although not shown in detail, sliding guides, which are configured to guide relative movement of the first housing 11 and the second housing 13 in the front-rear direction, are disposed in the vicinity of the elastic members 171 and 175, respectively.

With such a vibration-isolating structure, the first housing 11 and the second housing 13 are movable relative to each other in the front-rear direction. Thus, transmission of vibration (in particular, vibration in the extension direction of the driving axis A1 (i.e. vibration in the front-rear direction), which is the largest and dominant in vibration generated in the first housing 11 when the hammering operation is performed) from the first housing 11 to the second housing 13 can be effectively reduced.

The structures (elements, components) disposed in the first housing 11 are now described.

As shown in FIG. 1, the motor 2 is housed in the motor-housing part 117. In the present embodiment, a brushless DC motor is adopted as the motor 2. An upper end portion and a lower end portion of the motor shaft 25 are rotatably supported by bearings. The upper end portion of the motor shaft 25 protrudes into the driving-mechanism-housing part 111. A driving gear is formed on the upper end portion of the motor shaft 25.

The driving mechanism 3 is housed in the driving-mechanism-housing part 111. The driving mechanism 3 includes a motion-converting mechanism 30, a striking mechanism 36, and a rotation-transmitting mechanism 38.

The driving mechanism 3 having such a structure is well-known, and therefore it is briefly described below.

The motion-converting mechanism 30 is configured to convert rotary motion of the motor shaft 25 into a linear motion and transmits the linear motion to the striking mechanism 36. In the present embodiment, a crank mechanism, which includes a crank shaft and a piston, is adopted as the motion-converting mechanism 30. When the motor 2 is driven and the piston is moved frontward, the striking mechanism 36 transmits the kinetic energy to the tool accessory 18 by the action of an air spring. Thus, the tool accessory 18 is linearly driven along the driving axis A1 to strike a workpiece. On the other hand, when the piston is moved rearward, the striking mechanism 36 and the tool accessory 18 return to their respective original positions. In this way, the hammering operation is performed by the motion-converting mechanism 30 and the striking mechanism 36.

The rotation-transmitting mechanism 38 is configured to transmit rotational power of the motor shaft 25 to the tool holder 34. In the present embodiment, the rotation-transmitting mechanism 38 is formed as a gear-speed-reducing mechanism that includes a plurality of gears. A clutch (more specifically, positive clutch ((jaw clutch, dog clutch)) 39 is disposed on a power transmission path of the rotation-transmitting mechanism 38. When the clutch 39 is engaged (in an engaged state), the tool holder 34 is rotated by the rotation-transmitting mechanism 38, so that the tool accessory 18 attached to the tool holder 34 is rotationally driven around the driving axis A1. On the other hand, when the clutch 39 is disengaged (in a disengaged state) (FIG. 1 shows the disengaged state), the power transmission to the tool holder 34 by the rotation-transmitting mechanism 38 is interrupted, so that the tool accessory 18 is not rotationally driven.

In the present embodiment, the rotary hammer 101 is configured to operate in a mode (action/operation mode) selected from two modes, that is, a hammer mode (hammering only) and a hammer-drill mode (rotation with hammering). In the hammer mode, the clutch 39 is disengaged, and only the motion-converting mechanism 30 is driven, so that only the hammering operation is performed. In the hammer-drill mode, the clutch 39 is engaged, and the motion-converting mechanism 30 and the rotation-transmitting mechanism 38 are driven, so that both of the hammering operation and the drilling operation are performed.

Figure 2:
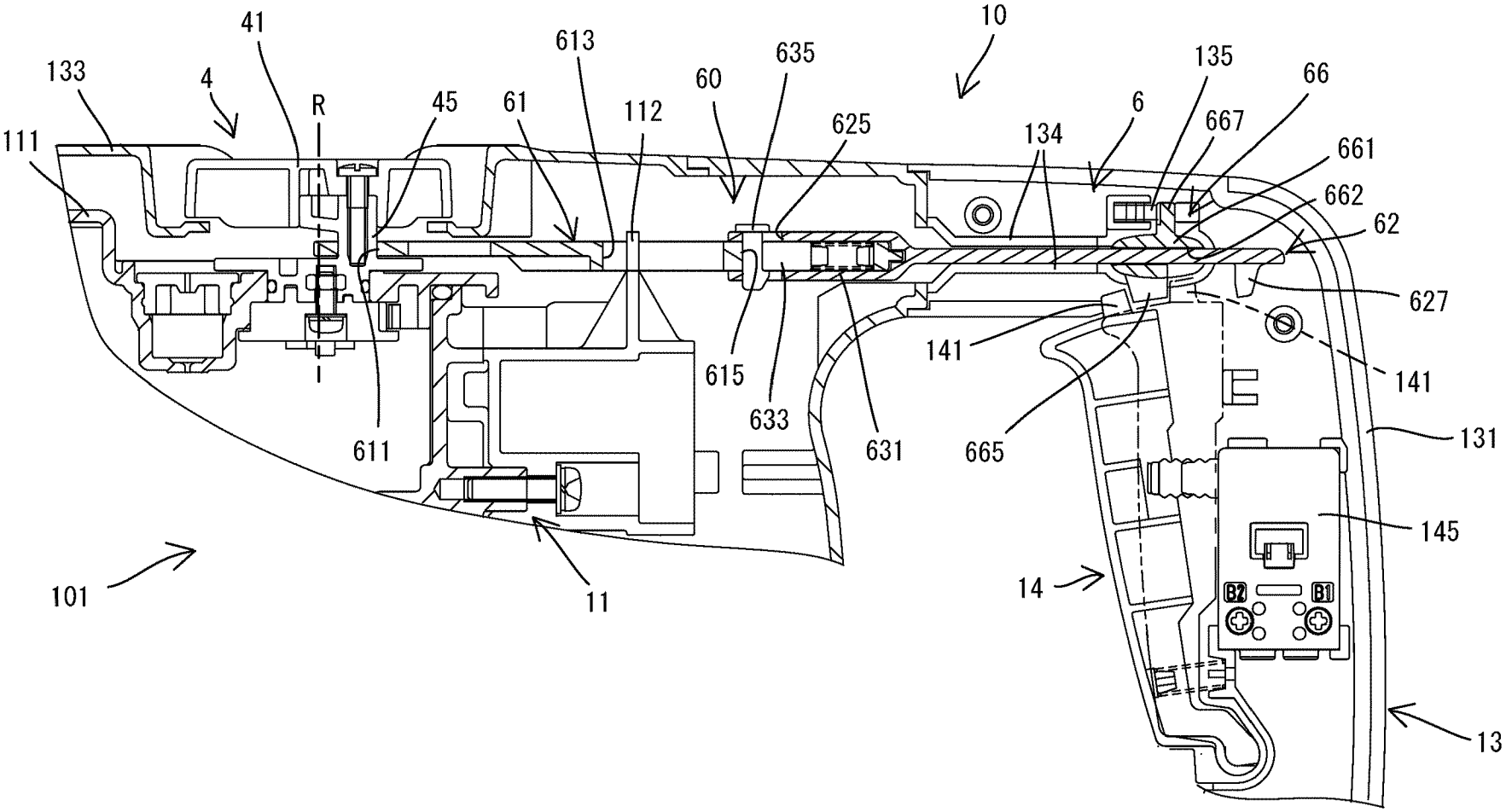
FIG. 2 is a partial enlarged view of FIG. 1.

As shown in FIG. 2, the rotary hammer 101 has a mode-switching dial (mode change knob) 4 that is configured to be manipulated by the user for selecting a mode. The mode-switching dial 4 is supported at an upper rear end portion of the first housing 11 (specifically, the driving mechanism housing 11) to be rotatable (pivotable) around a rotational axis R that extends in the up-down direction. Although the upper rear end portion of the driving-mechanism-housing part 111 is covered by the upper part 133 of the second housing 13, a disc-shaped manipulation part 41 of the mode-switching dial 4 is exposed outside of the second housing 13 through an opening formed in the upper part 133.

Two switching positions, which respectively correspond to the hammer mode and the hammer-drill mode, are defined for the mode-switching dial 4 in a circumferential direction around the rotational axis R. Although not shown in detail, symbols (e.g., graphics) that respectively correspond to the switching positions are indicated on the upper part 133, and a pointer is indicated on the manipulation part 41. The user can select a desired mode by manually rotating (pivoting) the manipulation part 41 and positions the pointer with one of the switching positions (one of the two symbols) that corresponds to the desired mode. The switching positions that correspond to the hammer mode and the hammer-drill mode are hereinafter referred to as a hammer position and a hammer-drill position, respectively.

As shown in FIG. 1, a clutch-switching mechanism 40 is disposed in the driving-mechanism-housing part 111. The clutch-switching mechanism 40 is connected to the mode-switching dial 4 and configured to switch the state of the clutch 39 between the engaged state and the disengaged state. When the mode-switching dial 4 is placed in (at) the hammer position (i.e., when the hammer mode is selected), the clutch-switching mechanism 40 disengages the clutch 39. On the other hand, when the mode-switching dial 4 is placed in (at) the hammer-drill position (i.e., when the hammer-drill mode is selected), the clutch-switching mechanism 40 engages the clutch 39. The structure of the clutch-switching mechanism 40 is well-known, and therefore detailed description and illustration thereof are herein omitted.

The structures (elements, components) disposed in the second housing 13 are now described.

Firstly, the structures (elements, components) disposed in the upper part 133 are described. As shown in FIG. 2, a locking mechanism 6 is disposed in a rear portion of the upper part 133. The locking mechanism 6 is configured to selectively restrict movement of the trigger 14 according to (depending on) the switching position of the mode-switching dial 4 (i.e., the mode selected by the user). The locking mechanism 6 will be described in detail below.

Next, the structures (elements, components) disposed in the grip 131 are described. As shown in FIG. 2, the grip 131 has a tubular shape and extends in the up-down direction. The trigger 14, which is configured to be to manually depressed (pulled) by the user, is disposed at a front side of the grip 131. The trigger 14 is configured to pivot generally in the front-rear direction within a specified pivotable range about a rotational axis (pivot axis) extending in the left-right direction. The trigger 14 is always biased forward by a plunger (and/or a biasing spring) of a main switch 145. When the trigger 14 is not depressed, the trigger 14 is held in (at) the frontmost position (a position shown by a solid line in FIG. 2) in the pivotable range. The trigger 14 is pivotable to the rearmost position (a position shown by a two-dot chain line in FIG. 2) in response to manual pressing being performed on the trigger 14 by the user. Two locking projections 141 project upward from an upper end of the trigger 14. In the present embodiment, the two locking projections 141 are spaced apart from each other in the left-right direction (see FIG. 4).

The main switch 145 is disposed in the grip 131. The main switch 145 is configured to be switched ON and OFF in response to the manipulation performed on the trigger 14 (i.e. movement of the trigger 14). Specifically, the main switch 145 is OFF while the trigger 14 is in (at) the frontmost position in a non-pressed state. On the other hand, when the trigger 14 is manually depressed and moved to a predetermined activation position within the pivotable range, the main switch 145 is turned ON. Although not shown, in the present embodiment, the rearmost position of the trigger 14 is set to a position slightly rearward relative to the activation position. The main switch 145 is OFF when the trigger 14 is located between the frontmost position and the activation position (excluding the activation position) within the pivotable range. The main switch 145 is ON when the trigger 14 is located between the activation position (including the activation position) and the rearmost position. Hereinafter, any position of the trigger 14 for making the main switch 145 OFF is referred to as an OFF position, and any position of the trigger 14 for making the main switch 145 ON is referred to as an ON position.

The structures (elements, components) disposed in the lower part 137 are now described. As shown in FIG. 1, the lower part 137 is shaped like a generally rectangular box having a partially open top, and is disposed below the motor-housing part 117.

A controller 5 is disposed within the lower part 137. Although not shown in detail, the controller 5 includes a case, a board housed in the case, and a control circuit mounted on the board. In the present embodiment, the control circuit is formed as a microcomputer including a CPU, a ROM, a RAM and the like. The controller 5 (control circuit) is electrically connected with the motor 2, the main switch 145, the battery-mounting parts 15 and the like via electric wires that are not shown. In the present embodiment, when the trigger 14 is manually depressed (pulled) and the main switch 145 is turned ON, the controller 5 (control circuit) starts to supply electric current to the motor 2 (i.e., starts to drive the tool accessory 18). When the manual depressing of the trigger 14 is cancelled (released, stopped) and the main switch 145 is turned OFF, the controller 5 stops supplying the electric current to the motor 2.

As described above, the battery-mounting parts 15 are disposed on the lower part 137. In the present embodiment, two battery-mounting parts 15 are arranged side by side in the front-rear direction. That is, two batteries 19 are attachable to the rotary hammer 101. Each of the battery-mounting parts 15 has an engagement structure that is slidable and engageable with the battery 19, and terminals that are electrically connectable to the battery 19. The structures of the battery-mounting part 15 is well-known, and therefore the detailed illustration and description thereof are omitted.

Figure 3:
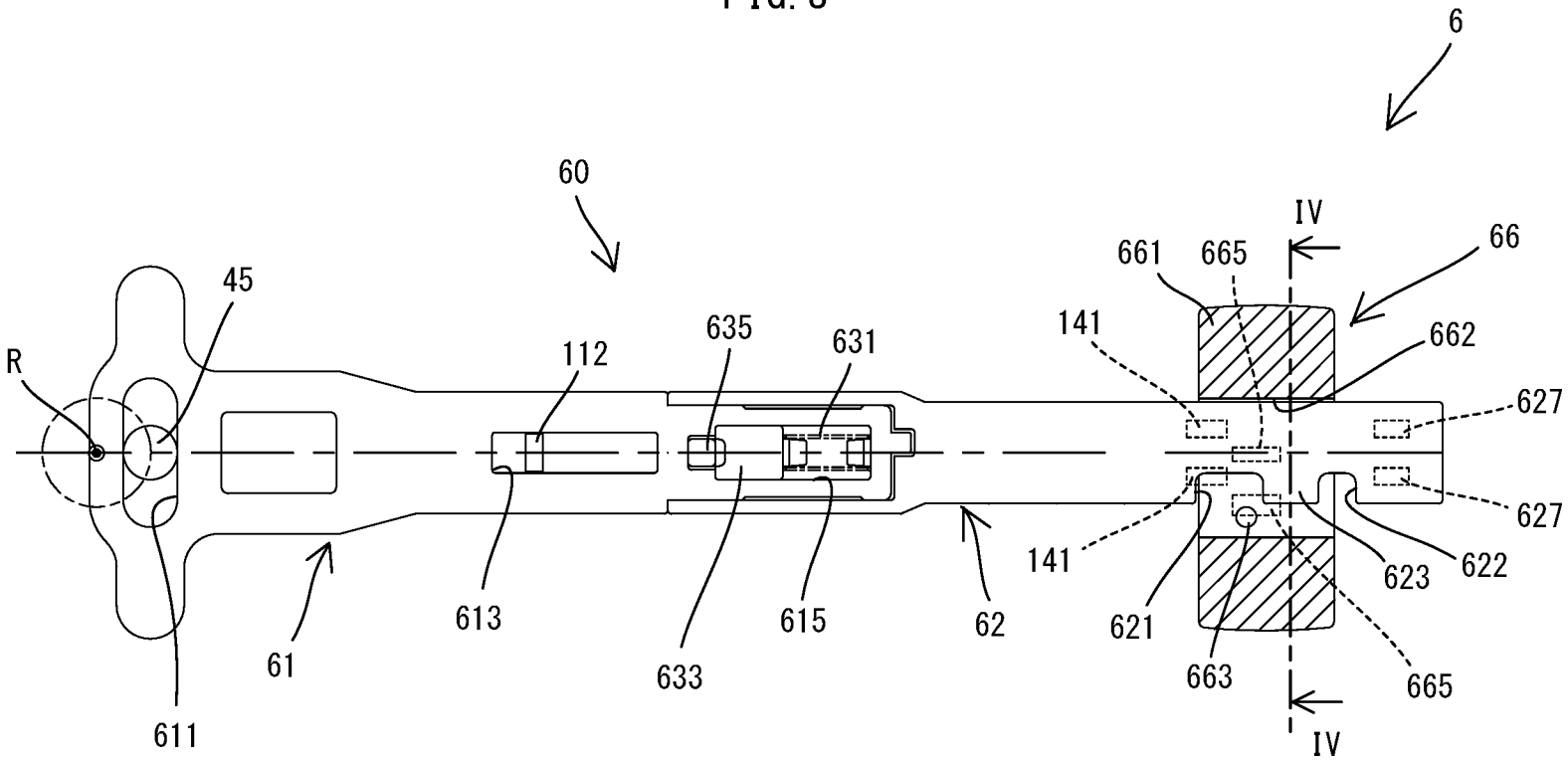
FIG. 3 is an explanatory drawing for illustrating an arrangement of a locking mechanism wherein the hammer mode has been selected and a locking member is in (at) an unlocking position.

The details of the locking mechanism 6 are now described. As shown in FIG. 2 and FIG. 3, in the present embodiment, the locking mechanism 6 includes an interlocking member 60 and a locking member 66.

Firstly, the interlocking member 60 is described. The interlocking member 60 is configured to move in response to a switching operation (movement) (specifically, rotational/pivotal movement) of the mode-switching dial 4. As shown in FIG. 2 and FIG. 3, the interlocking member 60 is formed as an elongate member and extends in a direction that is parallel to the driving axis A1 (i.e., in the front-rear direction). The interlocking member 60 includes a first member 61 and a second member 62, which are connected with each other so as to be movable relative to each other in the front-rear direction.

The first member 61 as a whole is a plate-like member that is elongate in the front-rear direction. The first member 61 has a generally T-shape when viewed from above. The first member 61 is disposed on an upper side of the first housing 11 (specifically, on the upper side of the driving-mechanism-housing part 111). The first member 61 is movably (operably) connected to the mode-switching dial 4. More specifically, a connection hole 611 is formed in (at) a front end portion of the first member 61. The connection hole 611 is an elongate hole that extends through the first member 61 in the up-down direction and that is elongate in the left-right direction. The mode-switching dial 4 includes an eccentric shaft 45. The eccentric shaft 45 is disposed at a position spaced apart from the rotational axis R of the mode-switching dial 4, and projects downward from the manipulation part 41. The eccentric shaft 45 is inserted into the connection hole 611 to be slidable within the connection hole 611.

A guide hole 613 is formed in (at) a substantially center portion of the first member 61 in the front-rear direction. The guide hole 613 is a through hole that is elongate in the front-rear direction and that has a rectangular shape when viewed from above. A guide projection 112 projects upward from a rear end portion of the first housing 11 (specifically, of the driving-mechanism-housing part 111). The guide projection 112 is inserted into the guide hole 613 to be slidable within the guide hole 613.

The second member 62 as a whole is an elongate member that extends in the front-rear direction. The second member 62 is connected to the first member 61 via a connecting member 635 so as to be movable relative to the first member 61 while being biased toward the first member 61. More specifically, a front end portion of the second member 62 is formed like a rectangular box having an open front end. The remaining portion of the second member 62 other than the front end portion is shaped like an elongate rectangular thin plate. A rear end portion of the first member 61 is disposed within the box-like front end portion of the second member 62 so as to be slidable in the front end portion of the second member 62 in the front-rear direction.

A connection hole 615 is formed in (at) a rear end portion (the portion that is disposed in the front end portion of the second member 62) of the first member 61. The connection hole 615 is a through hole having a generally rectangular shape that is elongate in the front-rear direction when seen from above. A biasing member 631 and a slider 633 are disposed in the connection hole 615. The biasing member 631 and a slider 633 are held between an upper wall and a lower wall of the front end portion of the second member 62. In the present embodiment, a compression coil spring is adopted as the biasing member 631. The slider 633 is a generally parallelepiped member that is slidable within the connection hole 615 in the front-rear direction. The biasing member 631 is disposed at a rear side of the slider 633 in the connection hole 615. A front end of the biasing member 631 contacts a rear end of the slider 633, and the other end (a rear end) of the biasing member 631 contacts a wall that defines a rear end of the connection hole 615.

Further, a connection hole 625 (see FIG. 2) is formed in (at) the front end portion of the second member 62. The connection hole 625 is a rectangular through hole when seen from above. The connecting member 635 is inserted into the connection hole 625 such that the connecting member 635 extends in the up-down direction. The connecting member 635 is held by the second member 62 in a state in which the connecting member 635 contacts the slider 633. In an initial state in which a rearward external force is not applied to the second member 62, the second member 62 is biased forward relative to the first member 61 by a biasing force of the biasing member 631 via the slider 633 and the connecting member 635, and is held in (at) a position in (at) which a front end of the second member 62 contacts, from the rear side, a shoulder part (see FIG. 3) formed on the first member 61. The position of the second member 62 relative to the first member 61 at this time (i.e., the position in (at) which the second member 62 is closest to the first member 61) is hereinafter referred to as an initial position.

Projections 627 project downward from the rear end portion of the second member 62. In the present embodiment, the second member 62 has two projections 627 that are spaced apart from each other in the left-right direction. The projections 627 are configured to selectively engage with the locking projections 141 of the trigger 14. Specifically, the projections 627 are respectively disposed such that the projections 627 at least partially overlap with the locking projections 141 when seen from the front or from the rear. Although the details will be described below, only when the hammer-drill mode is selected, the projections 627 are disposed on respective moving paths of the locking projections 141 of the trigger 14, and are engageable with the locking projections 141. Therefore, in the hammer-drill mode, when the second member 62 is pressed and moved rearward by the trigger 14, the second member 62 is moved relative to the first member 61 to a position that is rearward from the initial position.

As shown in FIG. 3, a width in the left-right direction of the rear end portion of the second member 62 is not uniform, and therefore the rear end portion includes wider portions and narrower portions in its width. In the present embodiment, a right end of the rear end portion of the second member 62 extends linearly in the front-rear direction. On the other hand, a left end of the rear end portion of the second member 62 has two recesses. Two recesses are spaced apart from each other in the front-rear direction and recessed rightward. Hereinafter, one of the two recesses disposed at a front side is referred to as a first recess 621, and the other recess at a rear side is referred to as a second recess 622. A portion between the first recess 621 and the second recess 622 in the front-rear direction is referred to as a projecting part 623. A width of a portion where the first recess 621 is formed and a width of a portion where the second recess 622 is formed in the rear end portion of the second member 62 are equal to each other. Portions (including the projecting part 623) other than the portions where the first recess 621 and the second recess 622 are formed in the rear end portion of the second member 62 have a larger uniform width. In other words, the projecting part 623 projects leftward from the portions where the first recess 621 and the second recess 622 are formed. A length of the first recess 621 in the front-rear direction is larger than that of the second recess 622.

As shown in FIG. 2, two guide ribs 134 are disposed in the rear end portion of the upper part 133 of the second housing 13. The guide ribs 134 project leftward from an inner surface of a right wall of the upper part 133. The two guide ribs 134 are spaced apart from each other in the up-down direction and extend in the front-rear direction in parallel with each other. A distance between the guide ribs 134 is slightly larger than a thickness in the up-down direction of the second member 62.

When the mode-switching dial 4 is rotated (pivoted) around the rotational axis R, the interlocking member 60 having the above-described structures is moved in the front-rear direction by a component in the front-rear direction of the revolution (rotational movement) of the eccentric shaft 45 around the rotational axis R. At this time, the guide projection 112 of the first housing 11 guides movement of the interlocking member 60 in the front-rear direction while restricting movement of the interlocking member 60 in the left-right direction. Further, the guide ribs 134 of the second housing 13 guide the movement of the interlocking member 60 in the front-rear direction while restricting movement of the interlocking member 60 in the up-down direction.

Figure 4:
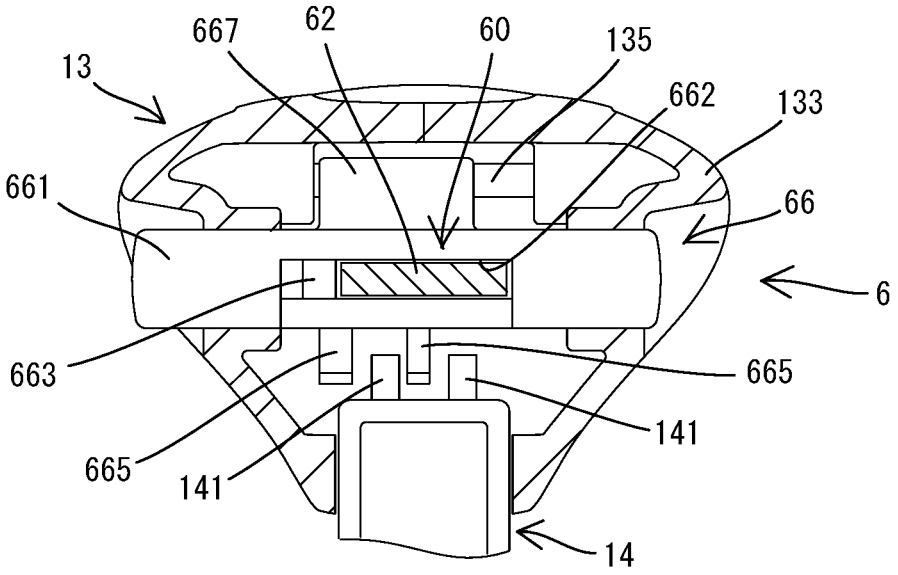
FIG. 4 is a cross-sectional view taken along line IV-IV in FIG. 3.

The locking member 66 is now described. The locking member 66 is configured to selectively restrict or allow movement of the trigger 14 between the OFF position and the ON position. As shown in FIG. 2 through FIG. 4, the locking member 66 of the present embodiment includes a main part 661, a pin 663, locking projections 665, and a spring receiver 667.

The main part 661 has a bar-like (rod-like) shape and extends in the left-right direction. The main part 661 has a passage 662 that extends through the main part 661 in the front-rear direction. A height in the up-down direction of the passage 662 is generally the same as a thickness in the up-down direction of the rear end portion (a portion on which the projections 627 are not disposed) of the second member 62 of the interlocking member 60. A width in the left-right direction of the passage 662 is uniform and is larger than a maximum width in the left-right direction of the rear end portion of the second member 62. The rear end portion of the second member 62 is always partially disposed in the passage 662 and is movable within the passage 662 in the front-rear direction.

The pin 663 is fixed to the main part 661 such that the pin 663 crosses (intersects) the passage 662 in the up-down direction. More specifically, the pin 663 is disposed in a left end portion of the passage 662. A diameter of the pin 663 is smaller than a depth of the first recess 621 and the second recess 622 of the interlocking member 60.

The locking projections 665 project downward from a lower end of the main part 661. In the present embodiment, the main part 661 has two locking projections 665 that are spaced apart from each other in the left-right direction. The locking projections 655 are configured to engage with the locking projections 141 of the trigger 14 when the locking member 66 is located in (at) a locking position (see FIG. 6), as will be described below. Specifically, the locking projections 665 are respectively disposed such that the locking projections 665 at least partially overlap with the locking projections 141 when seen from the front or from the rear when the locking member 66 is in (at) the locking position. A distance in the left-right direction between the two locking projections 665 of the locking member 66 is larger than a width in the left-right direction of each of the locking projections 141 of the trigger 14, and therefore each of the locking projections 141 is allowed to pass through a gap between the locking projections 665 in the front-rear direction. Further, a distance in the left-right direction between the two locking projections 141 of the trigger 14 is larger than a width in the left-right direction of each of the locking projections 665 of the locking member 66, and therefore each of the locking projections 665 is allowed to pass through a gap between the locking projections 141 in the front-rear direction.

The spring receiver 667 is a generally rectangular projecting piece that projects upward from an upper center portion of the main part 661. A flat spring 135 is supported in the rear end portion of the upper part 133 of the second housing 13, such that the flat spring 135 faces (opposes) the spring receiver 667 from the front. A center portion of the flat spring 135 is formed as a projecting part that projects rearward. Although not shown in detail, two recesses are formed in a front surface of the spring receiver 667. The flat spring 135 is configured to snap-engage with one of the two recesses via the projecting part.

As shown in FIG. 4, the locking member 66 formed as described above is disposed in the rear end portion of the upper part 133 to be movable in a direction (specifically, in the left-right direction) that intersects a moving direction of the interlocking member 60 and the trigger 14 (i.e., the front-rear direction). More specifically, through holes are formed at the rear side of the guide ribs 134 (see FIG. 2), in a left wall and a right wall of the upper part 133, respectively. The locking member 66 is held to be slidable in the left-right direction by the upper part 133 such that the left end portion and the right end portion of the main part 661 both project outside through the through holes.

The locking member 66 is movable between an unlocking position and the locking position in response to an external manipulation (specifically, manual pressing) performed by the user on the locking member 66.

In (at) the unlocking position, the locking member 66 allows the trigger 14 to move between the frontmost position and the rearmost position. As shown in FIG. 3 and FIG. 4, the unlocking position is defined as a position in (at) which the locking member 66 is incapable of contacting the trigger 14. More specifically, the unlocking position is defined as a position in (at) which the locking projections 665 of the locking member 66 are respectively offset (shifted, displaced) from (not located on) the moving paths of the locking projections 141 of the trigger 14. In the present embodiment, when the locking member 66 is in (at) the unlocking position, the locking projections 665 are offset from the moving paths of the locking projections 141, respectively, to the left. Further, the left end portion of the locking member 66 projects outside through the through hole of the left wall of the upper part 133. At this time, the projecting part of the flat spring 135 engages with the right one of the two recesses of the spring receiver 667, and thereby restricts sliding movement of the locking member 66 in the left-right direction. Thus, the locking member 66 is held in the unlocking position by the flat spring 135.

When the user manually presses the trigger 14 while the locking member 66 is located in (at) the unlocking position, the trigger 14 moves from the frontmost position (i.e., the OFF position shown by the solid line in FIG. 2) to the rearmost position (i.e., the ON position shown by the two-dot chain line in FIG. 2) because the locking projections 665 do not interfere with the locking projections 141. Further, when the user cancels (releases, stops) manual pressing of the trigger 14, the trigger 14 is biased frontward to be returned to the frontmost position while the locking projections 665 do not interfere with the locking projection 141.

Figure 5:
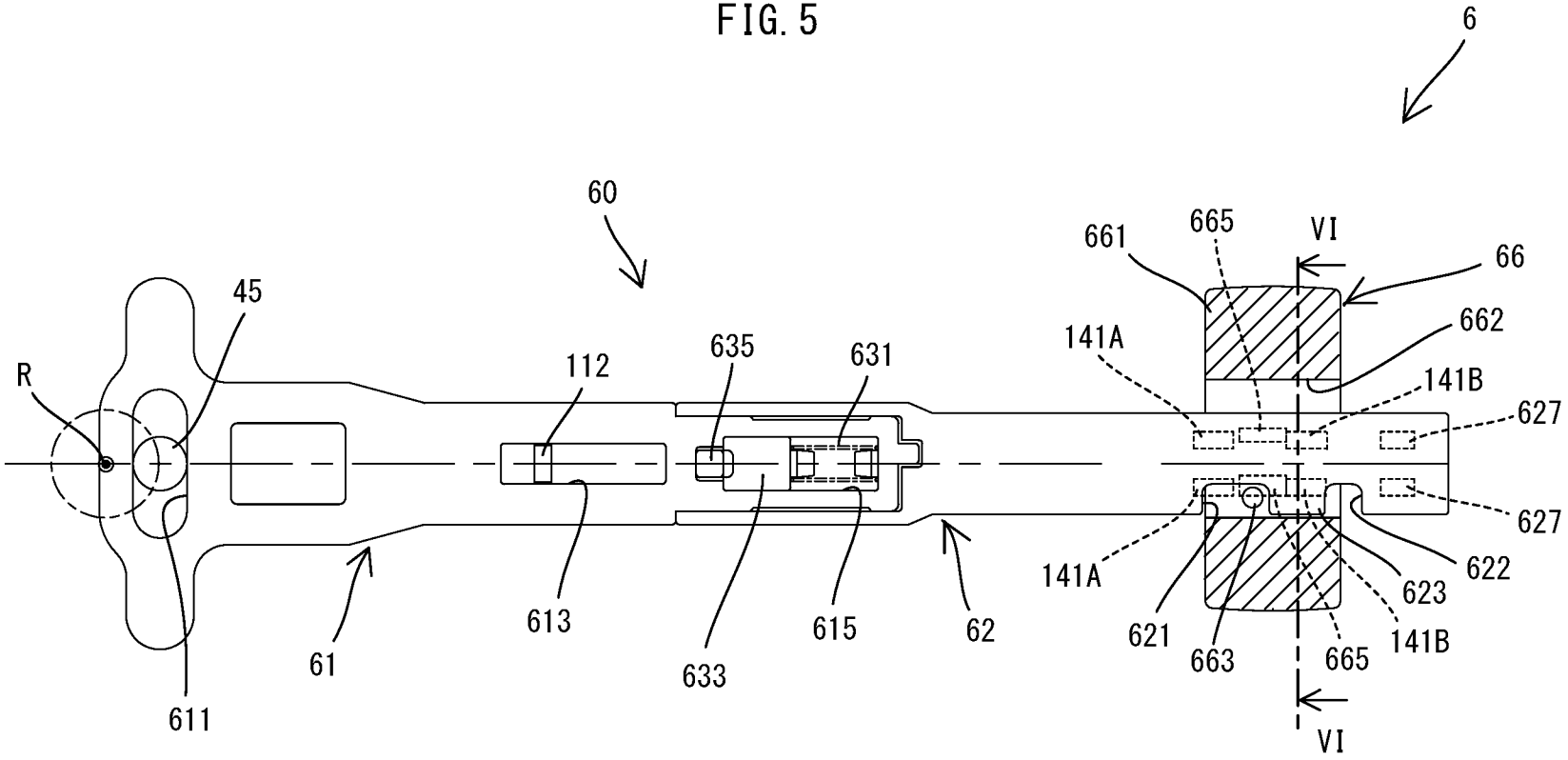
FIG. 5 is an explanatory drawing for illustrating the arrangement of the locking mechanism wherein the hammer mode has been selected and the locking member is in (at) a locking position.
Figure 6:
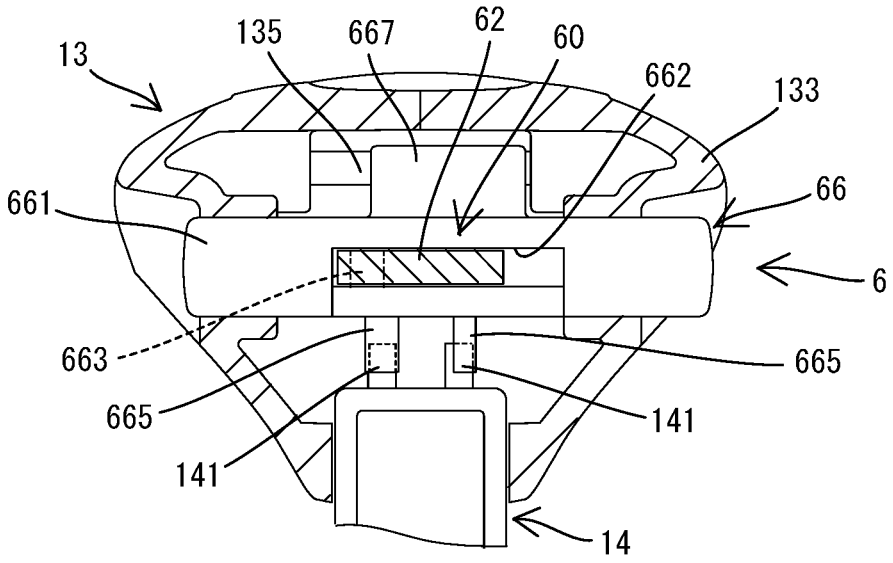
FIG. 6 is a cross-sectional view taken along line VI-VI in FIG. 5.

In the locking position, the locking member 66 restricts the movement of the trigger 14 between the frontmost position and the rearmost position. As shown in FIG. 5 and FIG. 6, the locking position is defined as a position in (at) which the locking member 66 is capable of contacting the trigger 14. More specifically, the locking position is defined as a position in (at) which the locking projections 665 of the locking member 66 are respectively disposed on the moving paths of the locking projections 141 of the trigger 14. In FIG. 5, reference numerals 141A denote the positions of the locking projections 141 when the trigger 14 is in the frontmost position, and reference numerals 141B denote the positions of the locking projections 141 when the trigger 14 is in the rearmost position. In the present embodiment, when the locking member 66 is in the locking position, the right end portion of the locking member 66 projects outside through the through hole of the right wall of the upper part 133. At this time, the projecting part of the flat spring 135 engages with the left one of the two recesses of the spring receiver 667, so that the locking member 66 is held in the locking position by the flat spring 135.

As shown by the solid line in FIG. 2, when the locking member 66 is placed in (at) the locking position while the trigger 14 is in (at) the frontmost position (i.e., the OFF position), the locking projections 665 are located directly behind the locking projections 141 (see reference numerals 141A in FIG. 5). Further, as shown in FIG. 5 and FIG. 6, the locking projections 665 are located at substantially the same positions as the locking projections 141 in the left-right direction. Thus, even if the user manually presses the trigger 14, the locking projections 665 respectively contact the locking projections 141 from the rear, and thereby prevent (block) the trigger 14 from moving further rearward to reach the activation position. Thus, when the locking member 66 is in (at) the locking position, the locking member 66 locks (holds) the trigger 14 in (at) the OFF position.

On the other hand, as shown by the two-dot chain line in FIG. 2, when the locking member 66 is placed in (at) the locking position while the trigger 14 is in (at) the rearmost position (i.e., the ON position), the locking projections 665 are located directly in front of the locking projections 141 (see reference numerals 141B in FIG. 5). Further, the locking projections 665 are located at substantially the same positions as the locking projections 141 in the left-right direction. Thus, even if the user cancels (releases, stops) the manual pressing of the trigger 14 and the trigger 14 is biased and thus slightly moves frontward, the locking projections 665 contact the locking projections 141 from the front, and thereby prevent (block) the trigger 14 from moving further forward to reach the activation position. Thus, when the locking member 66 is in (at) the locking position, the locking member 66 locks (holds) the trigger 14 in (at) the ON position.

In the present embodiment, the locking member 66 is selectively movable between the unlocking position and the locking position in response to the manual pressing being performed on the locking member 66 by the user. Specifically, whether or not the locking member 66 is movable between the unlocking position and the locking position depends on the switching position (i.e., the selected mode) of the mode-switching dial 4 and the position of the trigger 14 at that time.

The arrangements of the locking mechanism 6 that respectively correspond to the switching positions of the mode-switching dial 4 and operations (action) of the locking mechanism 6 in response to the manipulation of the trigger 14 are now described in detail.

Firstly, a case is described in which the mode-switching dial 4 is located in (at) the hammer position (i.e., a case in which the hammer mode has been selected).

As shown in FIG. 3, when the mode-switching dial 4 is in (at) the hammer position, the eccentric shaft 45 is located in (at) the rearmost position on its rotational path around the rotational axis R. Thus, as shown in FIG. 2 and FIG. 3, the first member 61 of the interlocking member 60 that is connected to the eccentric shaft 45 is also located in (at) the rearmost position (hereinafter referred to as a hammer position) in its moving range. The second member 62 is held in (at) the initial position relative to the first member 61 by the biasing force of the biasing member 631. At this time, the projections 627 of the second member 62 are disposed rearward of the rearmost positions of the locking projections 141 of the trigger 14 (see reference numerals 141B in FIG. 5). In other words, the projections 627 are respectively offset (shifted, displaced) from (not disposed on) the moving paths of the locking projections 141 in the front-rear direction. Thus, in the hammer mode, the second member 62 is held in the initial position, regardless of whether the trigger 14 is manually depressed or not.

When the first member 61 and the second member 62 are located in (at) the hammer position and the initial position, respectively, and the locking member 66 is located in (at) the unlocking position, a surface that defines a right end of the passage 662 of the locking member 66 faces (opposes) the right end surface of the rear end portion of the interlocking member 60 (the rear end portion of the second member 62), with a very small gap. A surface that defines the left end of the passage 662 of the locking member 66 is spaced leftward away from the left end surface of the rear end portion (a projecting end surface of the projecting part 623) of the interlocking member 60 (the second member 62). The pin 663 of the locking member 66 is located leftward of the first recess 621 (outside of the first recess 621) of the second member 62.

When the user manually presses and moves the locking member 66 from the left side to the right side while the trigger 14 is in (at) the frontmost position (i.e., the OFF position), as shown in FIG. 5, the pin 663 enters into the first recess 621 without interfering with the interlocking member 60. Thus, the user is able to move the locking member 66 to the locking position. When the locking member 66 is placed in (at) the locking position, the trigger 14 is locked in the OFF position (see reference numerals 141A in FIG. 5).

Similarly, the user is able to move the locking member 66 to the locking position after manually pressing the trigger 14 to the ON position. When the locking member 66 is placed in (at) the locking position, the trigger 14 is locked in the ON position (see reference numerals 141B in FIG. 5). Therefore, even if the user cancels the manual pressing of the trigger 14, the main switch 145 is kept ON. Accordingly, the controller 5 continuously drives the motor 2 and thus the driving mechanism 3 continuously performs the hammering operation. On the other hand, when the user manually presses the trigger 14 while the locking member 66 is in (at) the unlocking position, the controller 5 drives the motor 2 and the driving mechanism 3 performs the hammering operation only while the manual pressing of the trigger 14 is continued.

When the locking member 66 is in (at) the locking position, the pin 663 faces (opposes) a surface that defines a bottom of the first recess 621, with a very small gap therebetween. The pin 663 is disposed in a rear portion of the first recess 621 and there is a gap in front of the pin 663 between the pin 663 and a surface that defines a front end of the first recess 621. The surface that defines the left end of the passage 662 of the locking member 66 faces (opposes) the left end surface of the rear end portion (the projecting end surface of the projecting part 623) of the interlocking member 60 (the second member 62), with a very small gap.

When the hammering operation is performed, the largest and dominant vibration is generated in (on) the first housing 11 in the extension direction of the driving axis A1 (i.e., in the front-rear direction). As described above, in the present embodiment, the interlocking member 60 is connected to the mode-switching dial 4 that is supported by the first housing 11. On the other hand, the locking member 66 is held by the second housing 13, which is elastically connected to the first housing 11. Therefore, when the first housing 11 vibrates, the interlocking member 60 also vibrates with the first housing 11. The second housing 13, however, does not synchronously vibrate with the first housing 11. In the initial state, the second housing 13 is located in (at) the rearmost position relative to the first housing 11, owing to the biasing forces of the elastic members 171 and 175. And then, the second housing 13 moves between the rearmost position and a frontward position thereof in response to the vibration.

In the present embodiment, the interlocking member 60 is movable in the front-rear direction within the passage 662 of the locking member 66. When the locking member 66 is in (at) the unlocking position, as described above, the pin 663 is disposed outside of the first recess 621 (see FIG. 3). Therefore, even when the interlocking member 60 vibrates during the hammering operation, the interlocking member 60 and the locking member 66 are movable in the front-rear direction relative to each other without interfering with each other. When the locking member 66 is in (at) the locking position, as described above, the pin 663 is disposed in the first recess 621 of the interlocking member 60 (see FIG. 5). However, even when the interlocking member 60 vibrates during the hammering operation, the gap between the pin 663 and the surface that defines the front end of the first recess 621 can prevent the interference between the interlocking member 60 and the pin 663, so that the interlocking member 60 and the locking member 66 are movable in the front-rear direction relative to each other. With such a configuration, smooth relative movement of the first housing 11 and the second housing 13 can be secured during the hammering operation.

As described above, when the mode-switching dial 4 is in (at) the hammer position (i.e., when the hammer mode has been selected), the first member 61 and the second member 62 are located in (at) the hammer position and the initial position, respectively. The interlocking member 60 allows the locking member 66 to move between the locking position and the unlocking position both when the trigger 14 is located in (at) the OFF position and when the trigger 14 is located in (at) the ON position (i.e., regardless of the position of the trigger 14). Thus, in the hammer mode, the locking mechanism 6 is capable of locking the trigger 14 in each of the OFF position and the ON position.

Next, a case is described in which the mode-switching dial 4 is located in (at) the hammer-drill position (i.e., when the hammer-drill mode has been selected).

Figure 7:
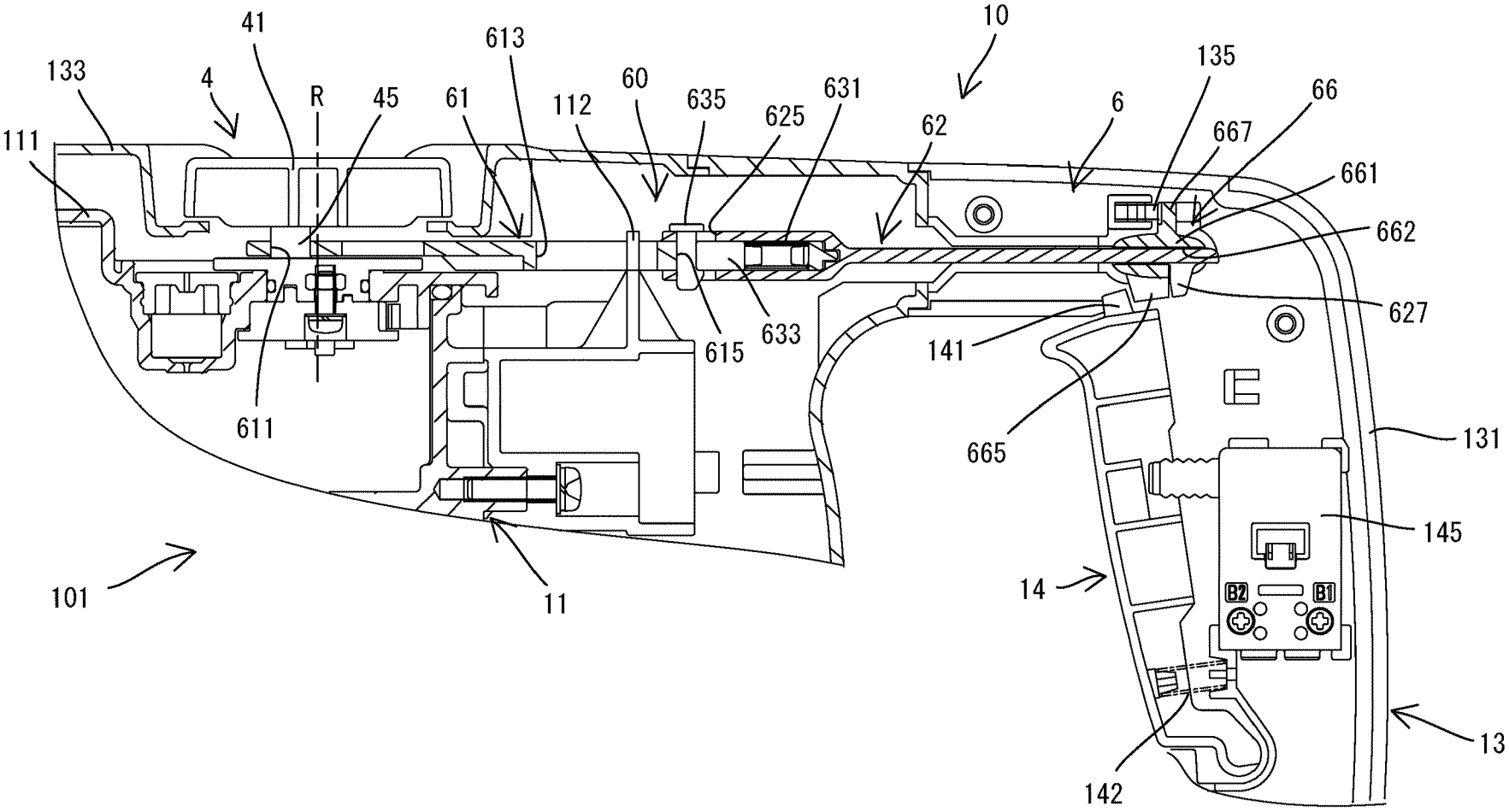
FIG. 7 is a partial cross-sectional view of the rotary hammer wherein a hammer-drill mode has been selected and a trigger is in (at) a frontmost position.
Figure 8:
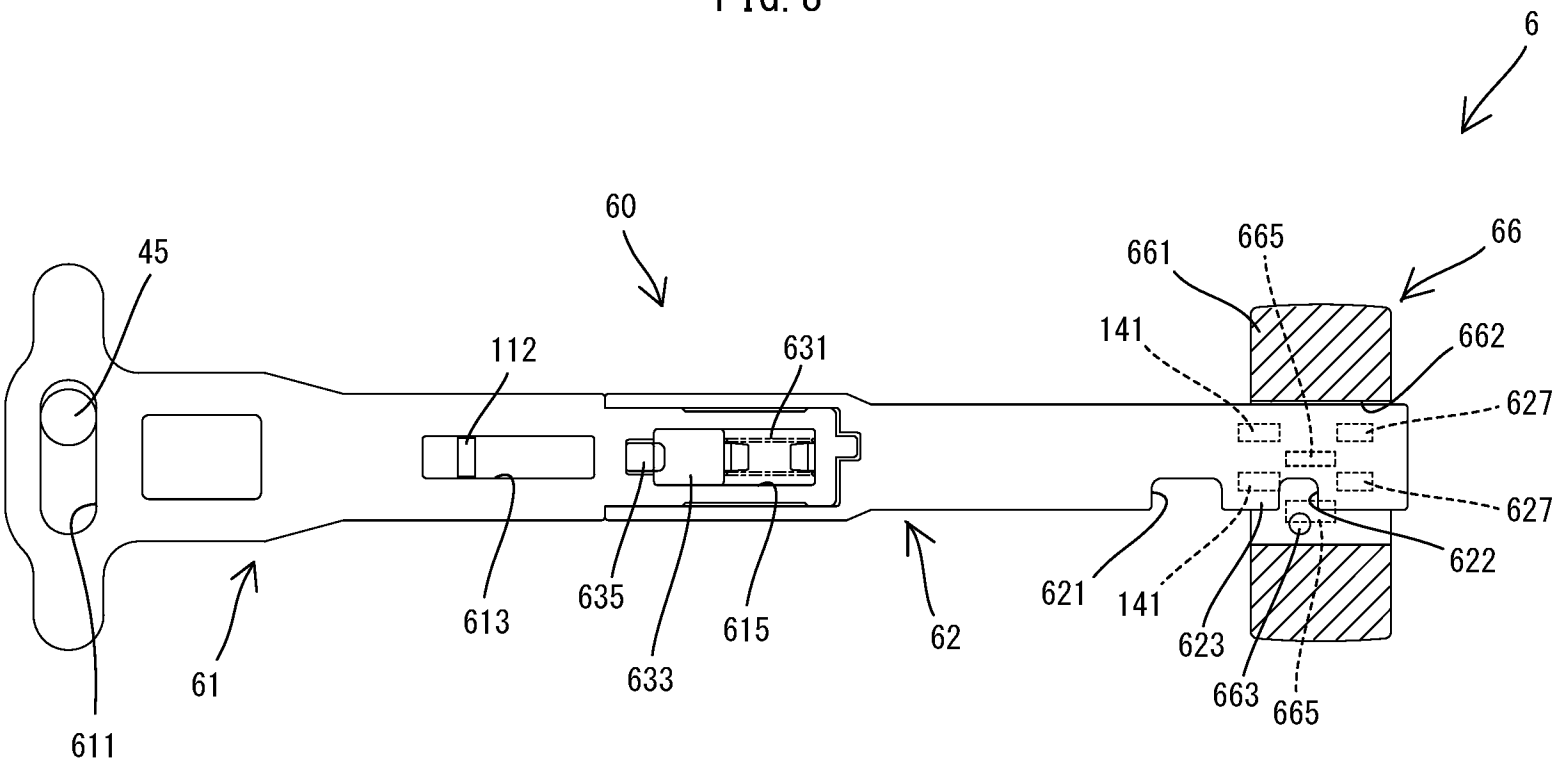
FIG. 8 is an explanatory drawing for illustrating the arrangement of the locking mechanism wherein the hammer-drill mode has been selected, the trigger is in (at) the frontmost position and the locking member is in (at) the unlocking position.

As shown in FIG. 7 and FIG. 8, when the mode-switching dial 4 is switched (shifted, moved, pivoted) from the hammer position to the hammer-drill position while the locking member 66 is in (at) the unlocking position and the trigger 14 is in (at) the frontmost position (i.e. the OFF position), the interlocking member 60 moves frontward in response to movement of the eccentric shaft 45. When the mode-switching dial 4 is placed at the hammer-drill position, the first member 61 of the interlocking member 60 is correspondingly placed in (at) a specified position (hereinafter referred to as a hammer-drill position) that is forward of the rearmost position. The second member 62 is placed in (at) the initial position relative to the first member 61 owing to the biasing force of the biasing member 631. At this time, the projections 627 of the second member 62 are placed in (at) substantially the same positions as expected positions of the locking projections 141 (see reference numerals 141B in FIG. 5) of the trigger 14 when the trigger 14 is move to the rearmost position. Thus, the projections 627 are respectively disposed on the moving paths of the locking projections 141 from the foremost position to the rearmost position, behind the locking projections 141.

When the first member 61 and the second member 62 are located in (at) the hammer-drill position and the initial position, respectively, and the locking member 66 is located in (at) the unlocking position, the surface that defines the right end of the passage 662 of the locking member 66 faces (opposes) the right end surface of the rear end portion of the interlocking member 60 (the rear end portion of the second member 62), with a very small gap. The pin 663 of the locking member 66 is disposed leftward of the second recess 622 (outside of the second recess 622).

Figure 9:
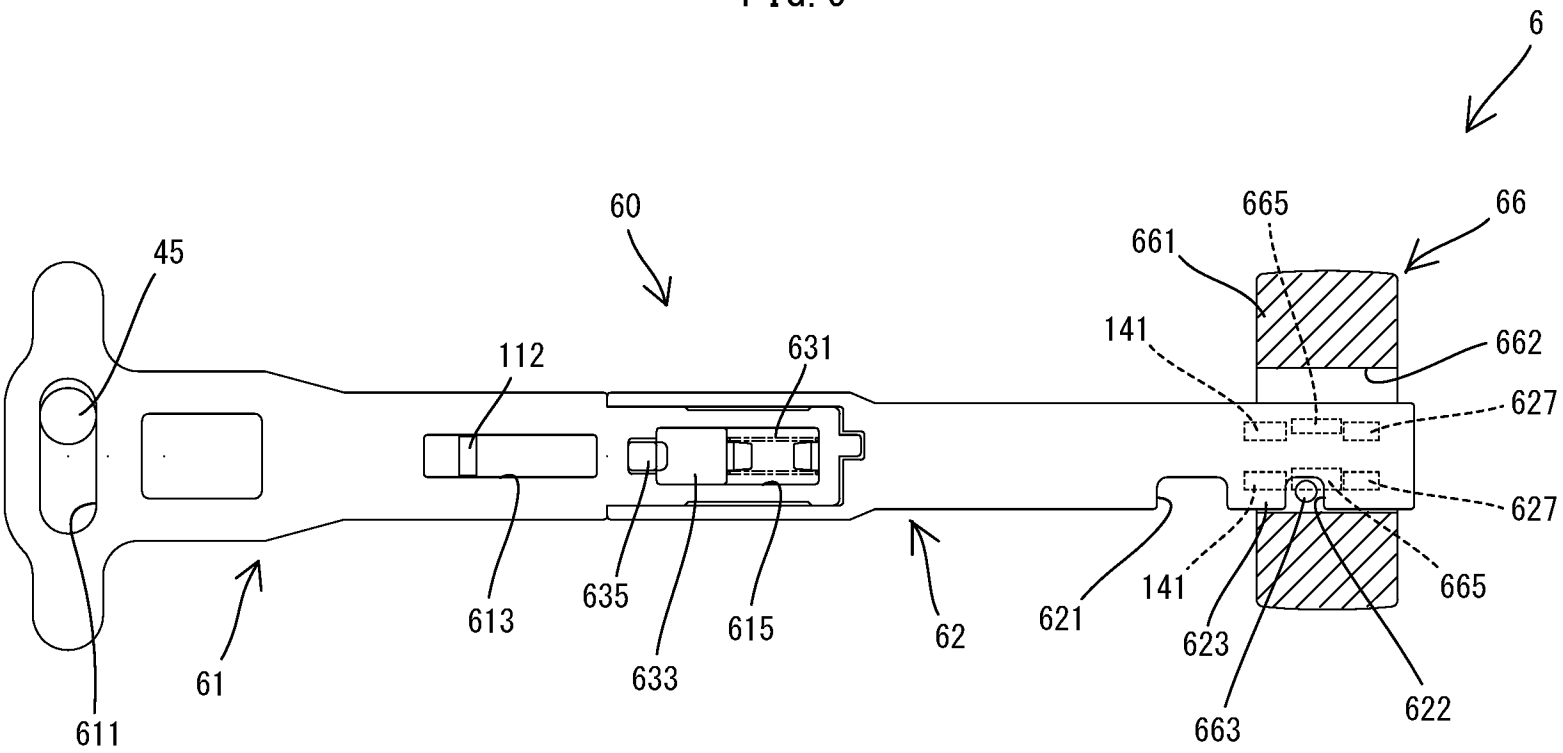
FIG. 9 is an explanatory drawing for illustrating the arrangement of the locking mechanism wherein the hammer-drill mode has been selected, the trigger is in (at) the frontmost position and the locking member is in (at) the locking position.

When the user manually presses and moves the locking member 66 from the left side to the right side while the trigger 14 is in (at) the frontmost position (OFF position), as shown in FIG. 9, the pin 663 enters into the second recess 622 without interfering with the interlocking member 60. The user is thus able to move the locking member 66 to the locking position. When the locking member 66 is placed in (at) the locking position, the trigger 14 is locked in the OFF position.

When the locking member 66 is in (at) the locking position, the pin 663 faces (opposes) a surface that defines a bottom of the second recess 622, with a very small gap. The pin 663 is disposed in a rear portion of the second recess 622. The surface that defines the right end of the passage 662 of the locking member 66 faces (opposes) the left end surface of the rear end portion (the projecting end surface of the projecting part 623 and the left end surface of a portion rearward of the second recess 622) of the interlocking member 60 (the second member 62), with a very small gap.

Figure 10:
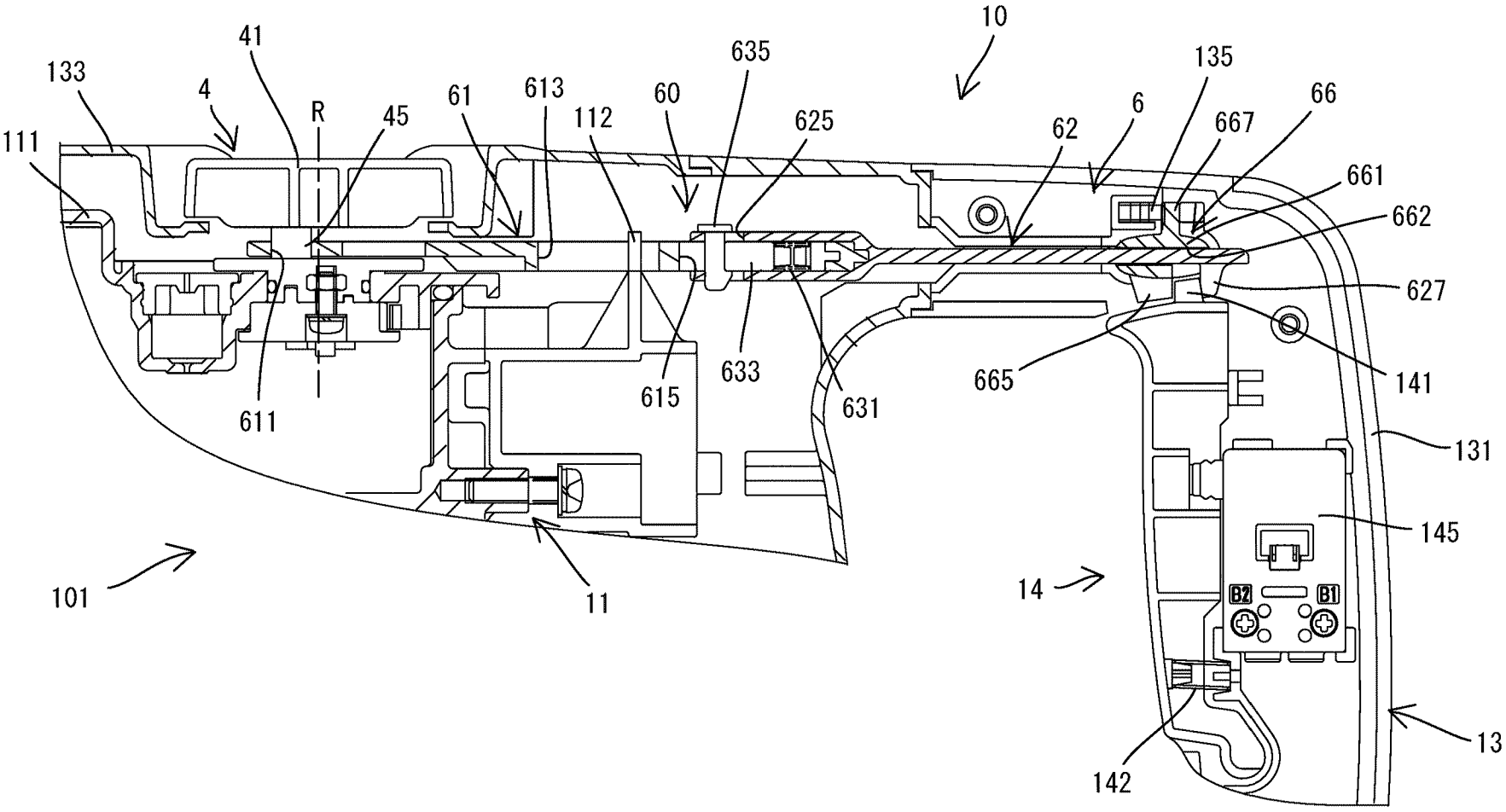
FIG. 10 is a partial cross-sectional view of the rotary hammer wherein the hammer-drill mode has been selected and the trigger is in (at) a rearmost position.
Figure 11:
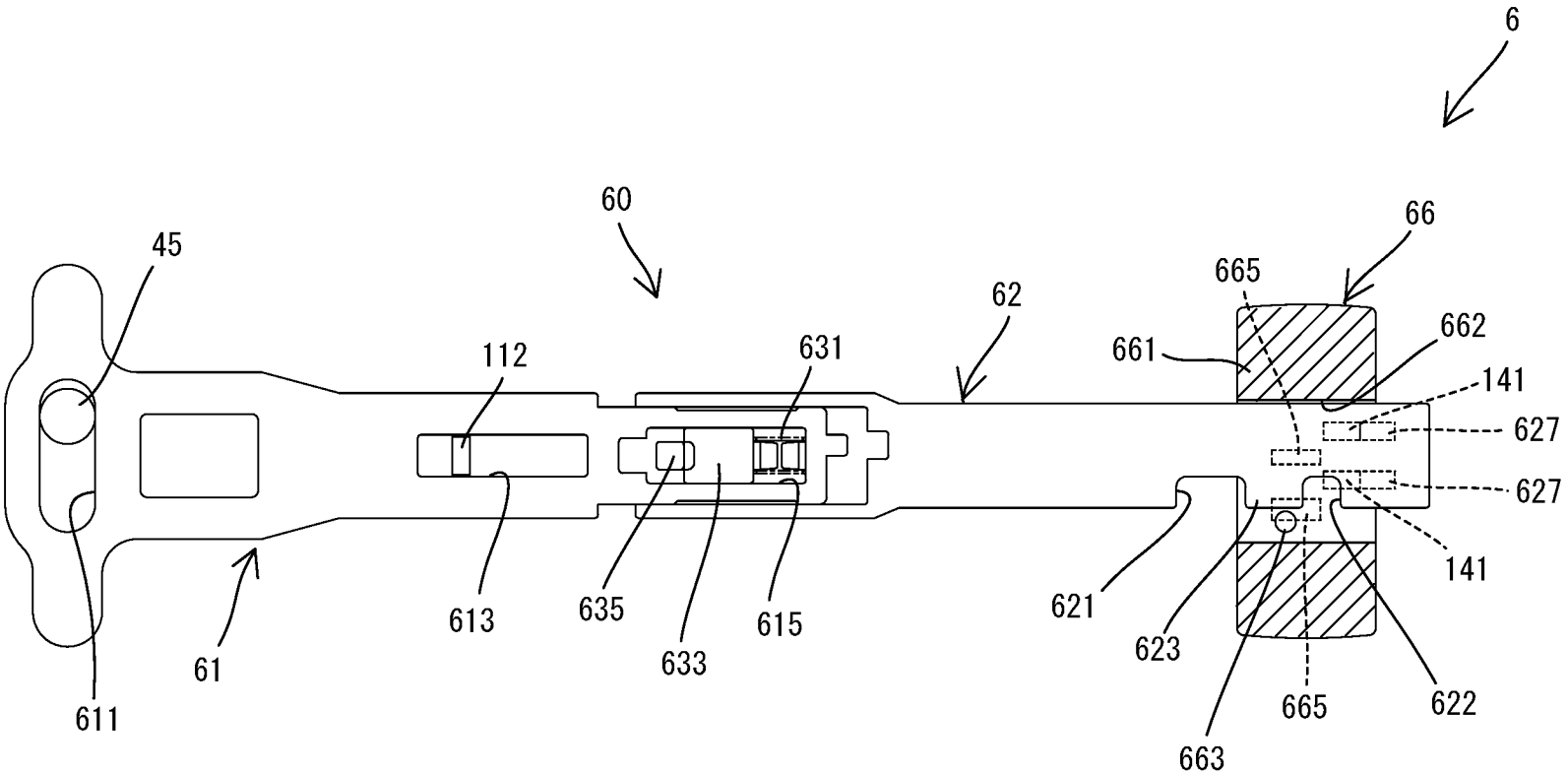
FIG. 11 is an explanatory drawing for illustrating the arrangement of the locking mechanism wherein the hammer-drill mode has been selected and the trigger is in (at) the rearmost position.

On the other hand, when the user manually presses the trigger 14 while the locking member 66 is in (at) the unlocking position, the locking projections 141 of the trigger 14 engage with (contact, abut on) the projections 627 of the second member 62 from the front before the trigger 14 reaches the activation position. As shown in FIG. 10 and FIG. 11, when the user further manually moves the trigger 14 to the ON position in a state in which the locking projections 141 engage with (are in contact with) the projections 627, the second member 62 moves away from the first member 61 (i.e., rearward from the initial position), which is positioned at the hammer-drill position, against the biasing force of the biasing member 631. In this manner, in the present embodiment, the locking projections 141 of the trigger 14 are effectively used for not only locking (holding) the trigger 14 in the OFF position and in the ON position by means of the engagement with the locking projections 665 of the locking member 66, but also for moving the second member 62 relative to the first member 61. The position of the second member 62 when the trigger 14 is in (at) the ON position is hereinafter referred to as a moved position.

When the first member 61 and the second member 62 are in (at) the hammer-drill position and the moved position, respectively, and the locking member 66 is in (at) the unlocking position, the surface that defines the right end of the passage 662 of the locking member 66 faces (opposes) the right end surface of the rear end portion of the interlocking member 60 (the rear end portion of the second member 62), with a very small gap. The pin 663 of the locking member 66 faces (opposes) the projecting end surface of the projecting part 623 (the left end surface of the interlocking member 60), with a very small gap. The projecting part 623 is disposed on a moving path of the pin 663 of the locking member 66 along which the pin 663 moves from the unlocking position to the locking position. Accordingly, even if the user tries to move the locking member 66 rightward toward the locking position, the projecting part 623 interferes with (contacts, abuts on) the pin 663, and prevents (blocks) the locking member 66 from moving further rightward.

As described above, when the mode-switching dial 4 is in (at) the hammer-drill position (i.e., when the hammer-drill mode has been selected), the first member 61 is located in (at) the hammer-drill position. Further, when the trigger 14 is in (at) the OFF position, the second member 62 is located in (at) the initial position relative to the first member 61 and allows the locking member 66 to move between the locking position and the unlocking position. Furthermore, when the trigger 14 is engaged with the trigger 14 and moved from the OFF position to the ON position, the second member 62 is moved rearward relative to the first member 61 by the trigger 14, so that the second member 62 is placed in (at) the moved position. When the second member 62 is located in (at) the moved position, the second member 66 prevents (blocks) the locking member 66 from moving from the unlocking position to the locking position. Thus, in the hammer-drill mode, the locking mechanism 6 is capable of locking (holding) the trigger 14 in the OFF position, but incapable of locking (holding) the trigger 14 in the ON position. Accordingly, the driving mechanism 3 performs the hammering operation and the drilling operation only during the period in which the user continues to manually press the trigger 14.

As described above, in the rotary hammer 101 of the present embodiment, in the hammer mode, the locking of the trigger 14 in the OFF position is allowed and also the driving of the motor 2 while the trigger 14 is locked in the ON position is allowed. On the other hand, in the hammer-drill mode, the locking of the trigger 14 in the OFF position is allowed, but the driving of the motor 2 while the trigger 14 is locked in the ON position is prohibited (disallowed).

Accordingly, in both of the hammer mode and the hammer-drill mode, unexpected driving of the tool accessory 18 can be reliably prevented by locking the trigger 14 in the OFF position using the locking mechanism 6. In the hammer mode, in which only the hammering operation is performed, the motor 2 can be continuously driven by locking the trigger 14 in the ON position using the locking mechanism 6, so that the user is free from the trouble to continue to press the trigger 14. In the hammer-drill mode, in which the hammering operation and the drilling operation are simultaneously performed, a possibility that the tool accessory 18 continues to rotate in a locked state due to jamming or binding, for example, can be reduced. In particular, in the hammer-drill mode, the interlocking member 60 prevents (blocks) the trigger 14 from being physically locked (held) in the ON position by the locking member 66, so that the continuous driving of the motor 2 can be reliably prevented (disallowed). Thus, the rotary hammer 101 according to the present embodiment has superior usability.

In the present embodiment, one single locking member 66 is configured to move between the unlocking position and the locking position in response to an external manual operation by the user, to thereby lock (hold) the trigger 14 in (at) each of the OFF position and the ON position. Thus, the locking mechanism 6 having a compact and simple structure is realized.

The locking mechanism 6 includes the interlocking member 60 that is configured to move in the front-rear direction in response to the switching operation (movement) of the mode-switching dial 4. The interlocking member 60 includes the first member 61 that is connected to the mode-switching dial 4, and the second member 62 that is connected to the first member 61 to be movable in the front-rear direction relative to the first member 61. The second member 62 moves relative to the first member 61 only when the hammer-drill mode has been selected and the trigger 14 is moved to the ON position, so that the second member 61 prohibits (blocks) the locking member 66 from moving from the unlocking position to the locking position. Accordingly, by simply manually switching (changing) the position of the mode-switching dial 4 depending on the desired mode and optionally manually pressing the trigger 14, the user can cause the interlocking member 60 to move and thereby appropriately allow or prohibit the movement of the locking member 66.

In particular, in the present embodiment, the locking member 66 is movable in the direction that intersects the moving direction of the second member 62. Further, the second member 62 is configured such that the position of the projecting part 623 relative to the pin 663 of the locking member 66 changes while the second member 62 is moved by the trigger 14. Also, whether the locking member 66 is allowed or disallowed to move to the locking position depends on whether the projecting part 623 is disposed on or out of (offset from) the moving path of the pin 663 of the locking member 66. Thus, the second member 62 that can selectively restrict the movement of the locking member 66 in response to its own movement is realized by the projecting part 623, which is simple in terms of structure.

Second Embodiment

A rotary hammer 102 according to a second embodiment will be described below, with reference to FIG. 12 through FIG. 17. The rotary hammer 102 includes a locking mechanism 7 having a structure that is different from that of the rotary hammer 101 of the first embodiment (see FIG. 1), and further includes a detecting mechanism 8 that is configured to detect a state of the locking mechanism 7. The locking mechanism 7 and the detecting mechanism 8 are disposed in the rear portion of an upper part 133. The structures (elements, components) other than the locking mechanism 7 and the detecting mechanism 8 are slightly different in shape, but substantially identical. Therefore, in the description and the drawings to be referred hereinafter, the same reference numerals are assigned to substantially the same structures (elements, components) as those in the first embodiment, and the description thereof will be simplified or omitted.

Figure 12:
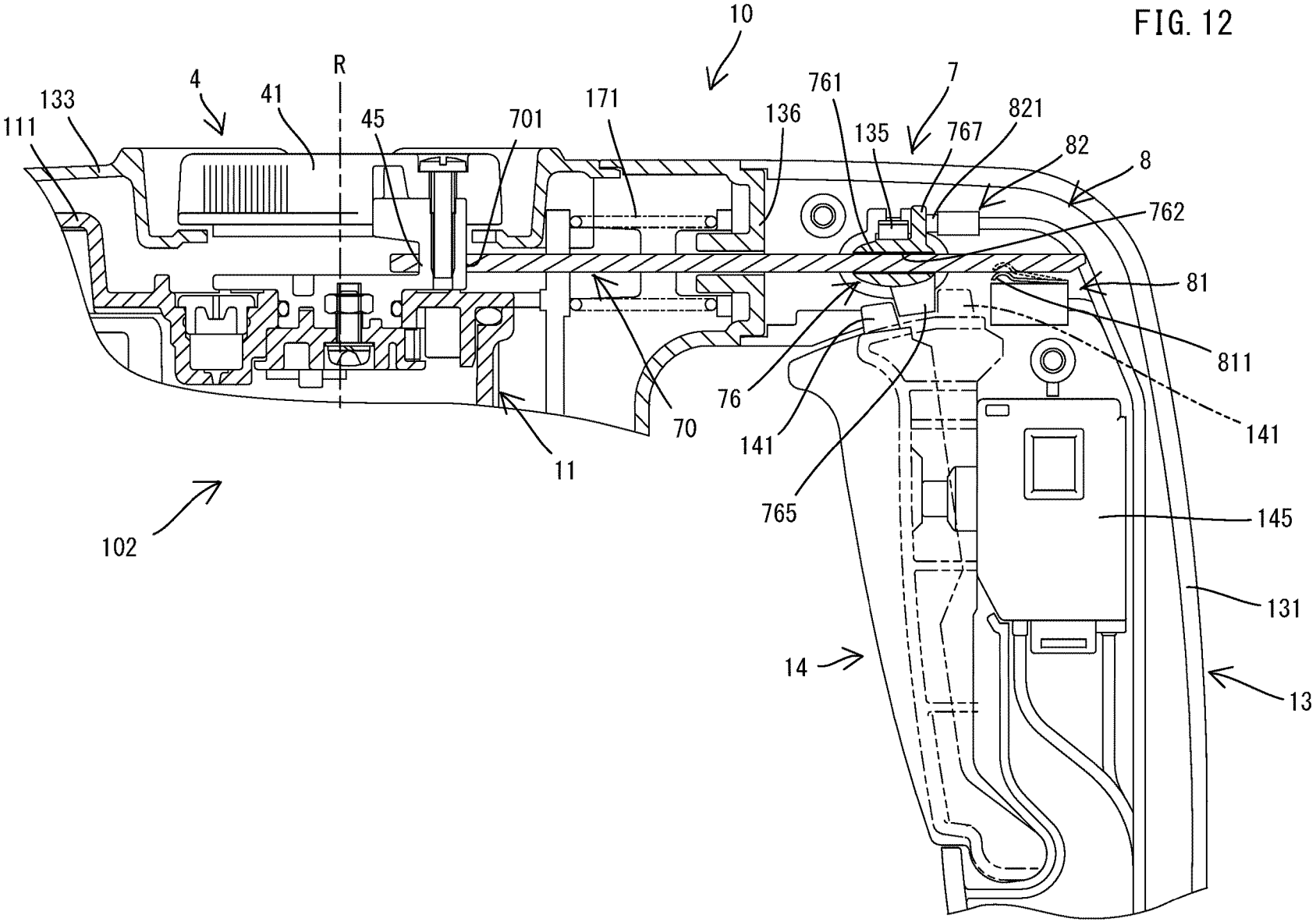
FIG. 12 is a partial cross-sectional view of another rotary hammer wherein the hammer mode has been selected.
Figure 13:
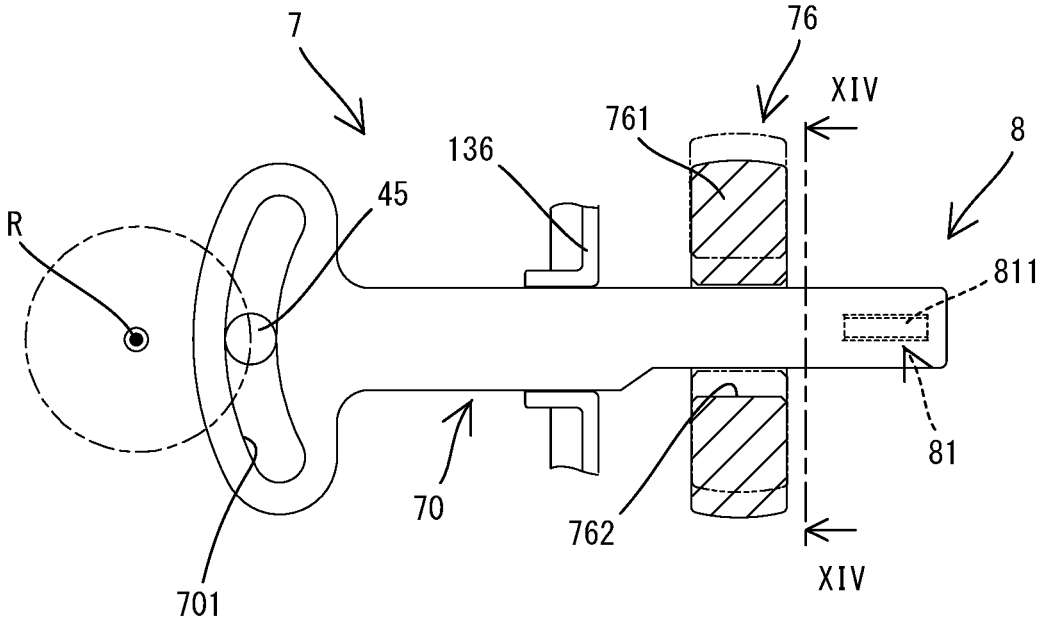
FIG. 13 is an explanatory view for illustrating an arrangement of a locking mechanism wherein the hammer mode has been selected.

The details of the locking mechanism 7 are now described. As shown in FIG. 12 and FIG. 13, the locking mechanism 7 includes an interlocking member 70 and a locking member 76.

Firstly, the interlocking member 70 is described. Similarly to the interlocking member 60 in the first embodiment (see FIG. 2), the interlocking member 70 in the present embodiment is an elongate member that is configured to move in response to a switching operation (movement) (specifically, a rotational/pivotal movement) of the mode-switching dial 4. The interlocking member 70 extends in a direction (i.e., in the front-rear direction) parallel to the driving axis A1 (see FIG. 1). The interlocking member 70 is a single (integral) member, unlike the first embodiment.

The interlocking member 70 as a whole is a plate-like member that is elongate in the front-rear direction. The interlocking member 70 has a generally T-shape when seen from above. The interlocking member 70 is disposed on the upper side of the first housing 11 (specifically, on the upper side of the driving-mechanism-housing part 111). The interlocking member 70 is movably (operably) connected to the mode-switching dial 4. More specifically, a connection hole 701 is formed in (at) a front end portion of the interlocking member 70. The connection hole 701 extends through the interlocking member 70 in the up-down direction. The connection hole 701 is an elongate hole that is elongated generally in the left-right direction. The eccentric shaft 45 of the mode-switching dial 4 is inserted into the connection hole 701 to be slidable within the connection hole 701. The remaining portion of the interlocking member 70 linearly extends in the front-rear direction from the front end portion of the interlocking member 70. The rear end portion of the interlocking member 70 has a uniform width in the left-right direction.

In the present embodiment, the interlocking member 70 is movable in a direction (i.e., in the front-rear direction) in parallel to the driving axis A1, within a predetermined moving range. A guide wall 136 is disposed in the rear end portion of the upper part 133 of the second housing 13. The guide wall 136 defines a passage extending in the front-rear direction. The interlocking member 70 extends through the passage such that a right side surface of the interlocking member 70 is always slidable on the guide wall 136. When the mode-switching dial 4 is rotated (pivoted), the interlocking member 70 is moved in the front-rear direction while sliding against the guide wall 136 by a component in the front-rear direction of the (revolution) rotational movement of the eccentric shaft 45 around the rotational axis R.

Figure 14:
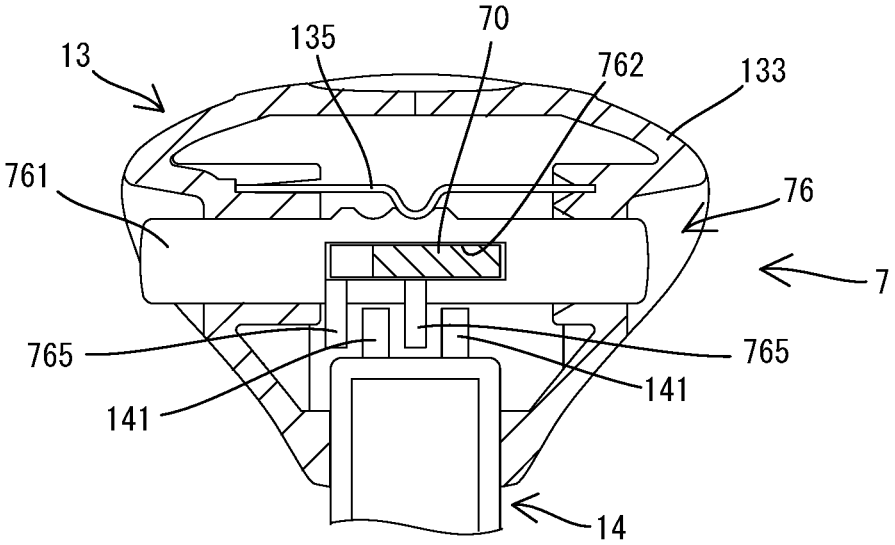
FIG. 14 is a cross-sectional view taken along line XIV-XIV in FIG. 13 wherein a locking member is in (at) the unlocking position.

Next, the locking member 76 is described. The locking member 76 in the present embodiment is similar to the locking member 66 in the first embodiment, and is configured to selectively restrict or allow movement of the trigger 14 between the OFF position and the ON position. As shown in FIG. 12 through FIG. 14, the locking member 76 includes a main part 761, locking projections 765, and a pressing projection 767.

The main part 761 has a bar-like (rod-like) shape and extends in the left-right direction. The main part 761 has a passage 762 that extends through the main part 761 in the front-rear direction. A height in the up-down direction of the passage 762 is generally the same as a thickness in the up-down direction of the rear end portion of the interlocking member 70. A width in the left-right direction of the passage 762 is larger than a width in the left-right direction of the rear end portion of the interlocking member 70. The rear end portion of the interlocking member 70 is always partially disposed in the passage 762 to be movable within the passage 762 in the front-rear direction. Two recesses, which are arranged side by side in the left-right direction, are formed in a center portion of an upper end portion of the main part 761. A flat spring 135 is supported in the rear end portion of the upper part 133 of the second housing 13, such that the flat spring 135 faces (opposes) the main part 761 from above. The flat spring 135 is disposed such that the projecting part formed in its center portion projects downward. The flat spring 135 is configured to snap-engage with one of the two recesses of the main part 761 via the projecting part.

The locking projections 765 project downward from a lower end of the main part 761. The locking projections 765 are configured to engage with the locking projections 141 of the trigger 14 when the locking member 76 is in (at) a locking position. The structures of the locking projections 765 are substantially the same as those of the locking projections 665 in the first embodiment.

The pressing projection 767 projects upward from an upper surface of the main part 761, behind the above-described recesses. The pressing projection 767 is configured to switch ON and OFF a second switch 82 according to the position of the locking member 76, as will be described below.

Figure 15:
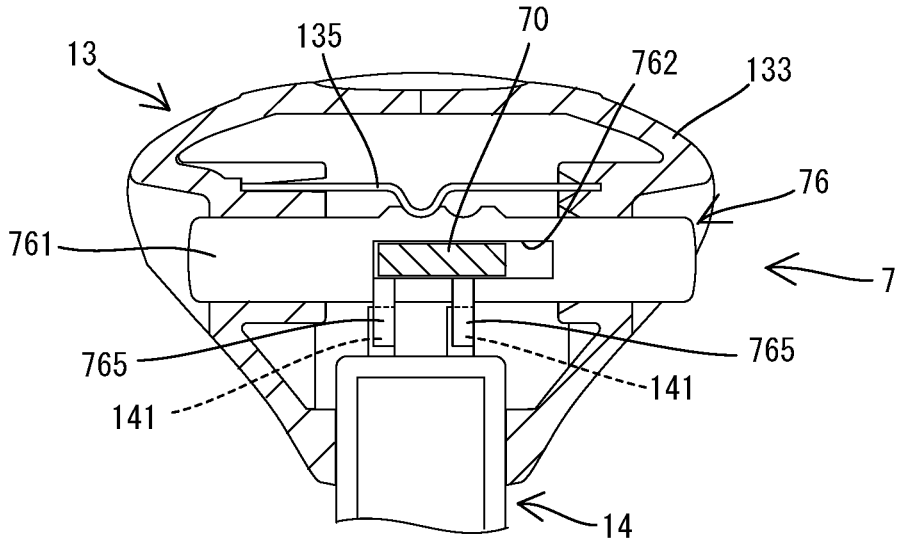
FIG. 15 is a cross-sectional view corresponding to FIG. 13 wherein the locking member is in (at) the locking position.

The locking member 76 formed as described above is held (supported) in the rear end portion of the upper part 133 so as to be movable in the left-right direction between an unlocking position shown in FIG. 14 and the locking position shown in FIG. 15 in response to an external manipulation (specifically, manual pressing) performed by a user. When the locking member 76 is in (at) the unlocking position, the trigger 14 is movable between the frontmost position (the OFF position) and the rearmost position (the ON position). On the other hand, when the locking member 76 is in (at) the locking position, the locking member 76 restricts the movement of the trigger 14 between the frontmost position and the rearmost position. Accordingly, the locking member 76 located in (at) the locking position is capable of locking the trigger 14 in the OFF position and in the ON position.

Figure 16:
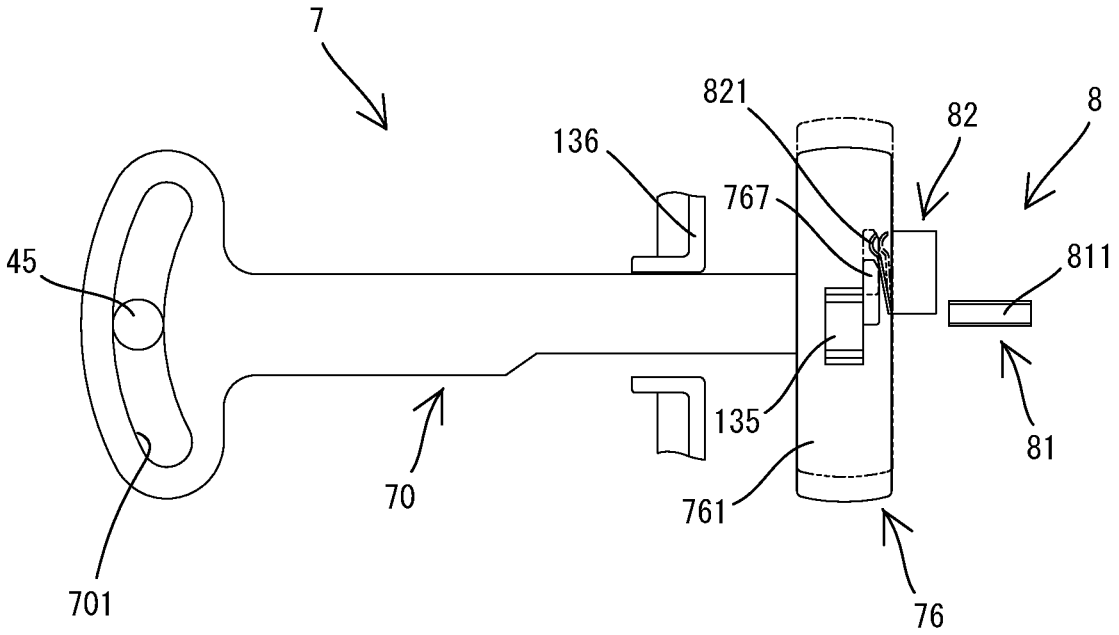
FIG. 16 is an explanatory drawing for illustrating the arrangement of the locking mechanism and an arrangement of a detecting mechanism wherein the hammer-drill mode has been selected.

The detecting mechanism 8 is now described. As shown in FIG. 12 and FIG. 16, the detecting mechanism 8 includes a first switch 81 and the second switch 82. Each of the first switch 81 and the second switch 82 is a mechanical switch (specifically, a micro switch having a well-known structure). The first switch 81 and the second switch 82, as well as the main switch 145, are each electrically connected to the controller 5 (see FIG. 1) via electrical wires.

The first switch 81 is switched ON and OFF according to the position of the interlocking member 70. Thus, the first switch 81 is configured to detect the position of the interlocking member 70. The first switch 81 is disposed rearward of the locking member 76 and below the interlocking member 70 such that a movable piece 811 for opening and closing a contact of the first switch 81 is disposed at an upper side of the first switch 81. As shown by a solid line in FIG. 12, the first switch 81 is arranged such that the movable piece 811 is pressed by the rear end portion of the interlocking member 70 when the interlocking member 70 is located in (at) the rearmost position.

The second switch 82 is switched between ON and OFF according to the position of the locking member 76. Thus, the second switch 82 is configured to detect the position of the locking member 76. The second switch 82 is disposed above the interlocking member 70 and rearward of the locking member 76 such that a movable piece 821 for opening and closing a contact of the second switch 82 is disposed at a front side of the second switch 82. As shown by a two-dot chain line in FIG. 16, the second switch 82 is arranged such that the movable piece 821 is pressed by the pressing projection 767 of the locking member 76 when the locking member 76 is located in (at) the locking position. Further, the second switch 82 is configured not to be activated while the first switch 81 is ON, and to be activated while the first switch 81 is OFF.

In the present embodiment, the locking member 76 is movable between the unlocking position and the locking position in response to manual pressing performed by the user. However, unlike the first embodiment, whether or not the locking member 66 is movable between the unlocking position and the locking position does not depend on the switching position of the mode-switching dial 4 (i.e., the selected mode) and the position of the trigger 14. Specifically, the locking member 76 is always movable between the unlocking position and the locking position. Further, unlike the first embodiment, the controller 5 (control circuit) is configured to control driving of the motor 2 based on not only the ON/OFF state of the main switch 145 of the trigger 14 but also the ON/OFF state of each of the first switch 81 and the second switch 82.

The arrangements of the locking mechanism 6 that respectively correspond to the switching positions of the mode-switching dial 4, operations (action) of the detecting mechanism 8, and driving modes of the motor 2 are now described in detail.

Firstly, a case is described in which the mode-switching dial 4 is located in (at) the hammer position (i.e., a case in which the hammer mode has been selected).

As shown in FIG. 12 and FIG. 13, when the mode-switching dial 4 is in (at) the hammer position, the eccentric shaft 45 is in (at) the rearmost position on its rotational path around the rotational axis R. At this time, the interlocking member 70 is also located in (at) the rearmost position (hereinafter referred to as a hammer position). The interlocking member 70 extends through the passage 762, and the rear end portion of the interlocking member 70 projects rearward of the locking member 76. When the locking member 76 is in (at) the unlocking position (the position shown by a solid line in FIG. 13), a surface that defines a left end of the passage 762 of the locking member 76 is spaced apart to the left from a left end surface of the rear end portion of the interlocking member 70. The interlocking member 70 allows the locking member 76 to move to the locking position (the position shown by a two-dot chain line in FIG. 13) without interfering with the locking member 76. Thus, in the hammer mode, the locking mechanism 7 is capable of locking the trigger 14 in the ON position as well as in the OFF position.

When the interlocking member 70 is in (at) the hammer position, the rear end portion of the interlocking member 70 presses the movable piece 811 of the first switch 81 as described above. Thus, the first switch 81 is kept ON. Accordingly, the second switch 82 is not activated.

In the present embodiment, when the first switch 81 is ON and the second switch 82 is not activated, the controller 5 drives the motor 2 while the main switch 145 is ON. Therefore, even if the user cancels the manual pressing of the trigger 14 while the trigger 14 is locked in the ON position, the controller 5 continuously drives the motor 2 and thus the driving mechanism 3 continuously performs the hammering operation. On the other hand, when the locking member 76 is in (at) the unlocking position, the controller 5 drives the motor 2 and the driving mechanism 3 performs the hammering operation only while the manual pressing of the trigger 14 is continued by the user.

Next, a case is described in which the mode-switching dial 4 is located in (at) the hammer-drill position (i.e., a case in which the hammer-drill mode has been selected).

Figure 17:
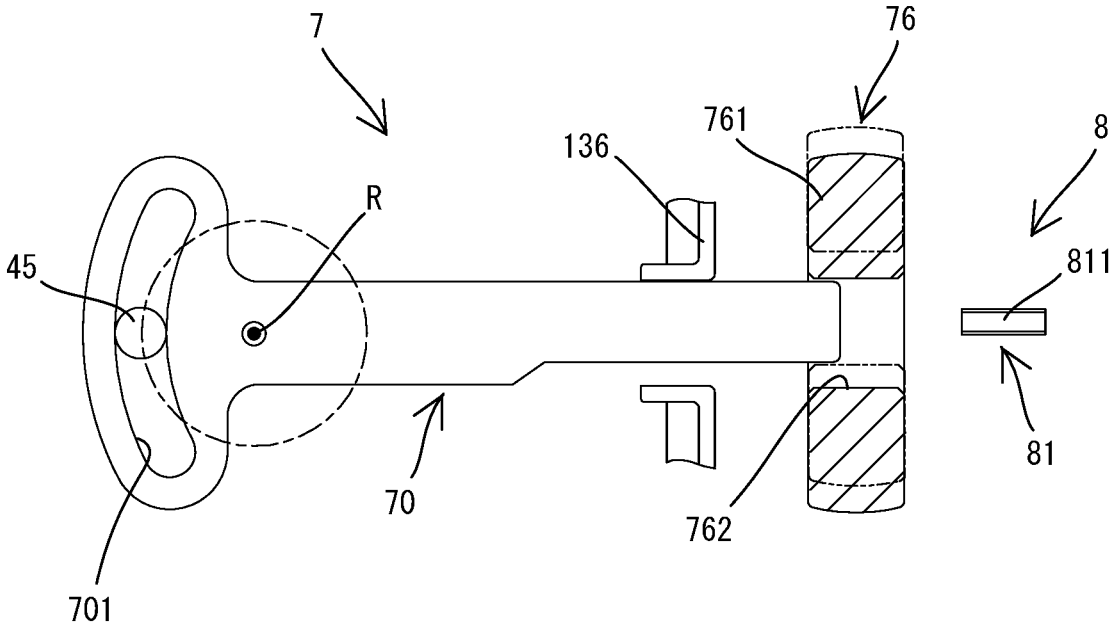
FIG. 17 is another explanatory drawing for illustrating the arrangement of the locking mechanism and the arrangement of the detecting mechanism wherein the hammer-drill mode has been selected.

When the mode-switching dial 4 is switched (shifted, moved, pivoted) from the hammer position to the hammer-drill position while the locking member 76 is in (at) the unlocking position and the trigger 14 is in (at) the frontmost position (OFF position), the interlocking member 70 moves frontward in response to movement of the eccentric shaft 45. When the mode-switching dial 4 is placed in (at) the hammer-drill position, as shown in FIG. 16 and FIG. 17, the interlocking member 70 is correspondingly placed in (at) the frontmost position (hereinafter referred to as a hammer-drill position) within its movable range. At this time, the rear end portion of the interlocking member 70 is placed in a front end portion of the passage 762. Similar to the case in which the interlocking member 70 is located in (at) the hammer position, the interlocking member 70 allows the locking member 76 to move to the locking position (the position shown by a two-dot chain line) without interfering with the locking member 76. Thus, in the present embodiment, also in the hammer-drill mode, the locking member 7 is capable of locking the trigger 14 in the ON position as well as in the OFF position.

When the interlocking member 70 is placed in (at) the hammer-drill position, the interlocking member 70 is spaced apart from the movable piece 811 of the first switch 81. Thus, in the hammer-drill mode, the first switch 81 is always OFF and thus the second switch 82 is always in an activated state. As shown in FIG. 16, when the locking member 76 is located in (at) the unlocking position (the position shown by a solid line), the pressing projection 767 does not press the movable piece 821 of the second switch 82 and thus the second switch 82 is OFF. On the other hand, when the locking member 76 is located in (at) the locking position (the position shown by the two-dot chain line), the pressing projection 767 presses the movable piece 821 of the second switch 82 and thus the second switch 82 is ON.

In the present embodiment, while the first switch 81 is OFF, the controller 5 drives the motor 2 based on the ON/OFF state of the second switch 82 and the ON/OFF state of the main switch 145. More specifically, while both of the first switch 81 and the second switch 82 are OFF, the controller 5 starts to drive the motor 2 when the main switch 145 of the trigger 14 is turned ON. Further, when the second switch 82 is turned ON (i.e., the locking member 76 is moved to the locking position) while the first switch 81 is OFF and the main switch 145 is ON, the controller 5 stops the driving of the motor 2. Thus, in the hammer-drill mode, unlike the hammer mode, the controller 5 prohibits (disallows) continuous driving of the motor 2 in a state in which the trigger 14 is locked in the ON position.

In the hammer mode, when the mode-switching dial 4 is switched (moved, pivoted) to the hammer-drill position while the trigger 14 is locked in the ON position and the motor 2 is being continuously driven, the first switch 81 is switched from ON to OFF in response to the movement of the interlocking member 70. Accordingly, the second switch 82 is activated, and the controller 5 recognizes that the second switch 82 is ON. In such a situation, because the second switch 82 is turned ON while the first switch 81 is OFF and the main switch 145 is ON, the controller 5 stops the driving of the motor 2. Thus, also when the mode is changed from the hammer mode to the hammer-drill mode, the controller 5 prohibits (disallows) the continuous driving of the motor 2 in a state in which the trigger 14 is locked in the ON position.

Further, in the hammer-drill mode, when the mode-switching dial 4 is switched (moved, pivoted) to the hammer position while the trigger 14 is locked in the ON position and the driving of the motor 2 is stopped, the first switch 81 is switched from OFF to ON while the main switch 145 is kept ON, and thus the second switch 82 is deactivated. In such a situation, the controller 5 waits until the main switch 145 is switched OFF. In other words, the controller 5 does not drive the motor 2 even if the mode is switched from the hammer-drill mode to the hammer mode while the trigger 14 is locked in the ON position, unless the user unlocks the trigger 14 to return the trigger 14 to the OFF position. The operation of the controller 5 after the main switch 145 is switched OFF is the same as that when the hammer mode is selected, as described above. Thus, when the mode is changed from the hammer-drill mode to the hammer mode, a reset manipulation for moving the trigger 14 to the OFF position is required.

As described above, also in the rotary hammer 102 according to the second embodiment, when the hammer mode is selected, the trigger 14 is allowed to be locked in the OFF position and the motor 2 is allowed to be driven in a state in which the trigger 14 is locked in the ON position. On the other hand, in the hammer-drill mode, although the trigger 14 is allowed to be locked in the OFF position, the motor 2 is disallowed to be driven in a state in which the trigger 14 is locked in the ON position. Thus, similar to the rotary hammer 101 of the first embodiment, the rotary hammer 102 has superior usability.

In the present embodiment, the first switch 81 and the second switch 82, which are switched ON and OFF, respectively, according to the position of the interlocking member 70 and the position of the locking member 76, are employed. Thus, the controller 5 can appropriately control the driving of the motor 2 based on the state of the main switch 145 and the states of the first switch 81 and the second switch 82.

The correspondences between the features of the above-described embodiments and the features in the present disclosure are as follows. The features of the above-described embodiments are merely exemplary and do not limit the features of the present disclosure or invention. Each of the rotary hammers 101 and 102 is an example of the "rotary hammer". The tool accessory 18 is an example of the "tool accessory". The driving axis A1 is an example of the "driving axis". The hammer mode is an example of the "hammer mode". The hammer-drill mode is an example of the "drill mode". The motor 2 is an example of the "motor". The trigger 14 is an example of the "manipulation member". The main switch 145 is an example of the "main switch". The mode-switching dial 4 is an example of the "mode-switching member". Each of the locking mechanisms 6 and 7 is an example of the "locking mechanism".

Each of the locking members 66 and 76 is an example of the "first locking member", and is also an example of the "second locking member". Further, each of the locking members 66 and 76 is also an example of the "single locking member". Each of the interlocking members 60 and 70 is an example of the "interlocking member". The first member 61 and the second member 62 are examples of the "first member" and the "second member", respectively. The biasing member 631 is an example of the "biasing member". The projecting part 623 is an example of the "projection". The pin 663 is an example of the "contact part". The locking projection 141 is an example of the "first projection". The projection 627 is an example of the "second projection". Each of the locking projections 665 and 765 is an example of the "third projection". The driving mechanism 3, the first housing 11, the second housing 13, and the grip 131 are examples of the "driving mechanism", the "first housing", the "second housing", and the "grip", respectively. The controller 5 (specifically, the control circuit) is an example of the "control device". The first switch 81 and the second switch 82 are examples of the "first switch" and the "second switch", respectively.

The above-described embodiments are merely exemplary embodiments of the present disclosure, and a rotary hammer according to the present disclosure is not limited to the rotary hammers 101 and 102 of the above-described embodiments. For example, the following modifications may be made. Further, one or more of these modifications may be employed in combination with one of the rotary hammers 101 and 102 of the above-described embodiment, or any one of the claimed features.

The plurality of modes (action modes) selectable in the rotary hammer 101, 102 are not limited to the hammer mode and the hammer-drill mode. A desired mode may be selected from the hammer mode (hammering only), in which only the hammering operation is performed, the hammer-drill mode (rotation with hammering), in which the hammering operation and the drilling operation are simultaneously performed, and a drill-only mode (rotation only), in which only the drilling operation is performed. The operation of the locking mechanism 6, 7 and the driving mode of the motor 2 controlled by the controller 5 when the drill-only mode is selected may be identical to those when the hammer-drill mode is selected. Further, the mode may be selected from two modes of the hammer mode (hammering only) and the drill-only mode (rotation only). Further, the plurality of modes may include a mode in which none of the hammering operation and the drilling operation is performed (for example, a mode in which the driving of the motor 2 is unconditionally prohibited (disallowed)). Instead of the mode-switching dial 4, which is rotated (pivoted) to change the switching positions, a mode-switching lever, which is linearly movable in a predetermined direction, may be employed for selecting the mode.

In the above-described embodiments, the rechargeable battery 19 is adopted as the power source. However, the rotary hammer 101, 102 may be connectable to an external commercial power source. In another embodiment in which the battery 19 is employed as the power source, the number of the battery-mounting parts 15 (the number of the batteries 19 attachable thereto) may be one or three or more. The structure of the driving mechanism 3 that drives the tool accessory 18 using the power that is generated by the motor 2 may be modified. For example, as the motion-converting mechanism 30, a known motion-converting mechanism that converts rotary motion of the motor 2 into linear motion using an oscillating member (e.g., a wobble plate, a swash bearing) may employed, instead of the above-described crank mechanism.

The structure of the housing 10 is not limited to that described in each of the above embodiments and thus may be modified. For example, the shapes of the first housing 11 and the second housing 13, the structure(s) of, the number of, and the position(s) of the elastic element(s) (e.g., the elastic members 171 and 175) interposed between the first housing 11 and the second housing 13 may be modified. Although it may be preferable that the housing 10 has a vibration-isolating structure, the vibration-isolating structure is not always imperative.

The structure and the arrangement of the locking mechanism 6, 7 may be modified. For example, the shape of the interlocking member 60, 70, the manner of connecting with the mode-switching dial 4, the manner of acting on the locking member 66, 76, the manner of engagement with the trigger 14 are not limited to those in the above embodiments, as long as the interlocking member 60, 70 is movable in response to the switching operation (movement) of the mode-switching dial 4 and disallow or allow the trigger 14 to move to the ON position in cooperation with the locking member 66, 77. Similarly, the shape of the locking member 66, 76, the positional relationship thereof with the interlocking member 60, 70, and the manner of engagement with the trigger 14, for example, are not limited to the examples in the above-described embodiments, as long as the locking member 66, 76 is movable between the locking position and the unlocking position in response to an external manipulation performed by a user.

For example, in the above embodiments, the single locking member 66, 76 achieves locking of the trigger 14 in the OFF position and locking of the trigger 14 in the ON position. However, a locking member that locks the trigger 14 in the OFF position and a locking member that locks the trigger 14 in the ON position may be two separate (discrete) members.

Each of the locking members 66 and 76 in the above-described embodiments is positioned at the same locking position both when locking the trigger 14 in the OFF position and when locking the trigger 14 in the ON position. However, the locking member 66, 76 may be configured to lock the trigger 14 in the OFF position when the locking member 66, 76 is located in (at) a first locking position and to lock the trigger 14 in the ON position when the locking member 66, 76 is located in (at) a second locking position that is different from the first locking position. In such a modified embodiment, for example, the unlocking position of the locking member 66, 76 may be set to a center position within the moving range of the locking member 66, 76. Further, the locking member 66, 76 may be moved from the unlocking position in a first direction to be placed in (at) the first position and may be moved from the unlocking position in a second direction that is opposite to the first direction to be placed in (at) the second position. Instead of being slidable in the left-right direction, the locking member 66, 76 may be slidable between the locking position and the unlocking position, for example, in the up-down direction or may be rotatable (pivotable) generally in the up-down direction around a rotational axis (pivot axis) extending in the left-right direction.

In the above embodiments, the locking member 66, 76 is placed on the moving path of the trigger 14 such that the locking member 66, 76 contacts (abuts on) the trigger 14 when the trigger 14 is slightly moved, so that the trigger 14 is prohibited (blocked) from moving from the OFF position to the ON position or from ON position to the OFF position. However, the manner of prohibiting the movement of the trigger 14 is not limited to this manner. For example, a manner in which the locking member 66, 76 contacts (abuts on) the trigger 14 that is located in (at) the frontmost position or in the rearmost position to hold the trigger 14 in a substantially unmovable manner, or a manner in which the locking member 66, 76 acts on and causes another component to come into contact with (abut on) the trigger 14 may be employed. The locking member 66, 76 and the trigger 14 may be configured to contact (abut on, engage with) not via the locking projections 665, 765 and the locking projections 141, but via other portions. For example, at least one projection provided on either one of the locking member 66, 76 and the trigger 14 may be engaged with a recess formed on the other of the locking member 66, 76 and the trigger 14.

The structure of the interlocking member 60 (specifically, the second member 62) that prohibits (blocks) the locking member 66 to move to the locking position in the hammer-drill mode (and/or in the drill-only mode) is not limited to that exemplarily described in the above-described embodiments. For example, the rear end portion of the second member 62 (at least a portion that moves in the passage 662 of the locking member 66) may have a uniform width in the left-right direction except the projecting part 623. Specifically, the rear end portion of the second member 62 may include a wider part and a narrower part, and only the projecting part 623 may be formed as the wide part, and the rest of the rear end portion of the second member 62 may be formed as the narrow part. A portion of the locking member 66 that is configured to make contact with (abut on) the projecting part 623 may be formed as, instead of the pin 663, for example, a projection projecting rightward from the surface that defines the left end of the passage 662.

The structure of the trigger 14 that moves the second member 62 relative to the first member 61 while moving from the OFF position to the ON position in the hammer-drill mode (and/or the drill-only mode) is not limited to that exemplarily described in the above embodiments. For example, the trigger 14 may have at least one locking projection that is engageable with the projection(s) 627 of the second member 62, separately from the locking projections 141. Further, a projection may be provided on either one of the second member 62 and the trigger 14 and a recess may be formed in the other of the second member 62 and the trigger 14 such that the projection engages with the recess.

The structures and the arrangements of the first switch 81 and the second switch 82 of the detecting mechanism 8 may be modified, as long as the ON/OFF states of the first switch 81 and the second switch 82 are respectively switched (changed) according to the positions of the interlocking member 70 and the locking member 76. For example, the first switch 81 and the second switch 82 may be switches of different types.

In the above-described embodiments, the control circuit of the controller 5 is described as being formed by a microcomputer including a CPU. However, the control circuit may be formed, for example, by a programmable logic device such as an ASIC (Application Specific Integrated Circuit) and an FPGA (Field Programmable Gate Array).

Further, in view of the nature of the present disclosure, the above-described embodiments and the modifications thereto, the following Aspects 1 to 2 are provided. Any one of the Aspects 1 to 2 can be employed alone or in combination with any one of the rotary hammers 101 and 102 described in the embodiments, the above-described modifications, and the claimed features.

(Aspect 1)

The second member includes a wider part and a narrower part, the wider part having a wider width than the narrower part in a second direction, the second direction intersecting the first direction;

the locking member has a contact part that is movable in the second direction and configured to contact the wider part; and the second member is configured such that, when the drill mode has been selected and the manipulation member is located in (at) the OFF position, the narrower part is spaced apart from and faces (opposes) the contact part in the second direction, and when the drill mode has been selected, the wider part is placed on a moving path of the contact part and faces (opposes) the contact part in response to the movement of the manipulation part from the OFF position to the ON position.

(Aspect 2)

The motor is a brushless motor.

DESCRIPTION OF THE REFERENCE NUMERALS

101, 102: rotary hammer, 10: housing, 11: first housing, 111: driving mechanism housing, 112: guide projection, 117: motor housing, 13: second housing, 131: grip, 133: upper portion, 134: guide rib, 135: flat spring, 136: guide wall, 137: lower portion, 14: trigger, 141: locking projection, 145: main switch, 15: battery attached part, 171: elastic member, 175: elastic member, 18: tool accessory, 19: battery, 2: motor, 25: motor shaft, 29: driving gear, 3: driving mechanism, 30: motion-converting mechanism, 34: tool holder, 36: striking mechanism, 38: rotation-transmitting mechanism, 39: clutch, 40: clutch-switching mechanism, 4: mode-switching dial, 41: manipulation part, 45: eccentric shaft, 5: controller, 6: locking mechanism, 60: interlocking member, 61: first member, 611: connection hole, 613: guide hole, 615: connection hole, 62: second member, 621: first recess, 622: second recess, 623: projection, 625: connection hole, 627: projection, 631: biasing member, 633: slider, 635: connection member, 66: locking member, 661: main part, 662: passage, 663: pin, 665: locking projection, 667: spring receiver, 7: locking mechanism, 70: interlocking member, 701: connection hole, 76: locking member, 761: main part, 762: passage, 765: locking projection, 767: pressing projection, 8: detecting mechanism, 81: first switch, 811: movable piece, 82: second switch, 821: movable piece, A1: driving axis, R: rotational axis.

What is claimed is:

1. A rotary hammer configured to operate in a mode selected from a plurality of modes including a hammer mode, in which a tool accessory attached to the rotary hammer is only linearly driven along a driving axis, and a drill mode, in which the tool accessory is at least rotationally driven around the driving axis, the rotary hammer comprising:

a motor configured to drive the tool accessory;

a manipulation member configured to be held in an OFF position in a non-pressed state and to move to an ON position in response to an external manual pressing on the manipulation member by a user;

a main switch configured to be kept OFF when the manipulation member is in the OFF position and to be kept ON when the manipulation member is in the ON position;

a mode-switching member configured to be switched between a plurality of switching positions in response to an external manipulation of the mode-switching member by the user for selecting one of the plurality of modes, the plurality of switching positions corresponding to the plurality of modes; and a locking member configured to selectively lock the manipulation member in the OFF position or the ON position according to the switching position of the mode-switching member;

wherein the locking member, the manipulation member and the motor are configured such that:

the locking member is allowed to lock the manipulation member in the OFF position both when the hammer mode has been selected and when the drill mode has been selected; and the motor is allowed to be driven in a state in which the manipulation member is locked in the ON position by the locking member only when the hammer mode has been selected.

2. The rotary hammer according to claim 1, wherein the locking member and the manipulation member are configured such that:

the locking member is movable between a first position in which the locking member is capable of contacting the manipulation member and a second position in which the locking member is incapable of contacting the manipulation member; and the locking member locks the manipulation member in the OFF position by contacting the manipulation member when the manipulation member is in the OFF position and locks the manipulation member in the ON position by contacting the manipulation member when the manipulation member is in the ON position.

3. The rotary hammer according to claim 2, further comprising:

a control device configured to control driving of the motor;

a first switch;

a second switch; and an interlocking member configured to (i) move in a first direction in response to a switching operation of the mode-switching member and (ii) be at different positions when the hammer mode has been selected and when the drill mode has been selected, wherein:

the first switch is configured to be switched ON and OFF according to the position of the interlocking member;

the second switch is configured to be switched ON and OFF according to the position of the locking member; and the control device is configured to control the driving of the motor based on respective states of the main switch, the first switch and the second switch.

4. The rotary hammer according to claim 3, wherein the interlocking member, the main switch, the first switch, the second switch are configured such that:

when the state of the first switch indicates that the interlocking member is in a position corresponding to the hammer mode, the control device drives the motor while the main switch is ON regardless of the state of the second switch; and when the state of the first switch indicates that the interlocking member is in a position corresponding to the drill mode, the control device drives the motor while the main switch is ON only in a case in which the state of the second switch indicates that the locking member is in the second position in which the locking member is incapable of contacting the manipulation member.

5. The rotary hammer according to claim 3, wherein each of the first switch and the second switch is a mechanical switch configured to be switched ON and OFF when the interlocking member or the locking member physically acts on the mechanical switch.

6. The rotary hammer according to claim 2, further comprising an interlocking member configured to move in a first direction in response to a switching operation of the mode-switching member, wherein:

the interlocking member includes a first member connected to the mode-switching member and a second member connected to the first member to be movable relative to the first member; and the interlocking member, the locking member and the manipulation member are configured such that:

when the hammer mode has been selected, the interlocking member allows the locking member to move to the first position regardless of the position of the manipulation member;

when the drill mode has been selected and the manipulation member is in the OFF position, the interlocking member allows the locking member to move to the first position; and when the drill mode has been selected, the second member is moved relative to the first member by engaging the manipulation member, in response to movement of the manipulation member from the OFF position to the ON position, to prevent the locking member from moving to the first position.

7. The rotary hammer according to claim 6, wherein the interlocking member and the manipulation member are configured such that, when the hammer mode has been selected, the second member is not engageable with the manipulation member and maintains a same position relative to the first member.

8. The rotary hammer according to claim 7, wherein the interlocking member further includes a biasing member configured to bias the first member and the second member towards each other in the first direction.

9. The rotary hammer according to claim 8, wherein the second member is configured to be moved away from the first member in the first direction against a biasing force of the biasing member in response to the movement of the manipulation member from the OFF position to the ON position.

10. The rotary hammer according to claim 9, wherein:

the second member has a projection that projects in a second direction, the second direction intersecting the first direction;

the locking member is movable in the second direction and has a contact part configured to selectively contact the projection; and the second member is configured such that, when the drill mode has been selected and the manipulation member is in the OFF position, the projection is offset from a moving path of the contact part, and when the drill mode has been selected, the projection is moved and placed on the moving path of the contact part in response to the movement of the manipulation member from the OFF position to the ON position.

11. The rotary hammer according to claim 10, wherein the second member is configured such that, when the hammer mode has been selected, the projection is at a position offset from the moving path of the contact part, regardless of the position of the manipulation member.

12. The rotary hammer according to claim 6, wherein the interlocking member further includes a biasing member configured to bias the first member and the second member towards each other in the first direction.

13. The rotary hammer according to claim 12, wherein the second member is configured to be moved away from the first member in the first direction against a biasing force of the biasing member in response to the movement of the manipulation member from the OFF position to the ON position.

14. The rotary hammer according to claim 6, wherein:

the second member has a projection that projects in a second direction, the second direction intersecting the first direction;

the locking member is movable in the second direction and has a contact part configured to selectively contact the projection; and the second member is configured such that, when the drill mode has been selected and the manipulation member is in the OFF position, the projection is offset from a moving path of the contact part, and when the drill mode has been selected, the projection is moved and placed on the moving path of the contact part in response to the movement of the manipulation member from the OFF position to the ON position.

15. The rotary hammer according to claim 14, wherein the second member is configured such that, when the hammer mode has been selected, the projection is offset from the moving path of the contact part, regardless of the position of the manipulation member.

16. The rotary hammer according to claim 6, wherein:

the manipulation member has a first projection, the second member has a second projection that is engageable with the first projection, and the manipulation member is configured to move the second member relative to the first member in a state in which the first projection and the second projection are engaged with each other, while moving from the OFF position to the ON position.

17. The rotary hammer according to claim 16, wherein the locking member has a third projection configured to selectively engage with the first projection of the manipulation member to thereby lock the manipulation member in the OFF position and/or in the ON position.

18. The rotary hammer according to claim 6, further comprising:

a driving mechanism configured to drive the tool accessory using power of the motor;

a first housing that houses the motor and the driving mechanism and that supports the mode-switching member; and a second housing that includes a grip configured to be gripped by the user and that is elastically connected to the first housing to be movable relative to the first housing in at least the first direction parallel to the driving axis, wherein:

the interlocking member is connected to the mode-switching member, the locking member and the manipulation member are supported by the second housing, and the interlocking member and the locking member are movable relative to each other in the first direction.

* * * * *